US006701646B2

(12) United States Patent
Schultz et al.

(10) Patent No.: US 6,701,646 B2
(45) Date of Patent: Mar. 9, 2004

(54) SPRING BRACKET DESIGN AND METHOD FOR SNOW PLOW BLADE TRIPPING MECHANISM

(75) Inventors: Lynn W. Schultz, Campbellsport, WI (US); Timothy G. Koch, Theresa, WI (US); Terry C. Wendorff, Cedarburg, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 10/192,577

(22) Filed: Jul. 10, 2002

(65) Prior Publication Data

US 2004/0006896 A1 Jan. 15, 2004

(51) Int. Cl.[7] ..... E01H 5/04

(52) U.S. Cl. ..... 37/232

(58) Field of Search ..... 37/232, 233, 234, 37/235, 236, 264, 266, 231; 172/811, 817, 275, 260.5, 272

(56) References Cited

U.S. PATENT DOCUMENTS

| | | | | | |
|---|---|---|---|---|---|
| 3,250,026 | A | * | 5/1966 | Jocher et al. | 37/232 |
| 3,650,054 | A | * | 3/1972 | Hanson | 37/232 |
| 3,775,877 | A | * | 12/1973 | Gove, Sr. | 37/233 |
| 3,845,577 | A | * | 11/1974 | Naymik | 37/231 |
| 3,987,562 | A | | 10/1976 | Deen et al. | |
| 4,304,057 | A | | 12/1981 | Watson et al. | |
| 4,619,060 | A | | 10/1986 | Knowlton | |
| 4,658,519 | A | | 4/1987 | Quenzi | |
| 4,747,612 | A | | 5/1988 | Kuhn | |
| 4,794,710 | A | * | 1/1989 | Haring | 37/232 |
| 4,962,599 | A | | 10/1990 | Harris | |
| 4,976,053 | A | | 12/1990 | Caley | |
| 5,036,608 | A | | 8/1991 | Ciula | |
| 5,050,321 | A | | 9/1991 | Evans | |
| 5,075,988 | A | | 12/1991 | Ciula | |
| 5,082,065 | A | | 1/1992 | Fletcher | |
| 5,109,618 | A | * | 5/1992 | Grubler et al. | 37/232 |
| 5,111,603 | A | | 5/1992 | Knowlton et al. | |
| 5,191,729 | A | * | 3/1993 | Verseef | 37/232 |
| 5,193,296 | A | | 3/1993 | Reilly | |
| 5,285,588 | A | * | 2/1994 | Niemela et al. | 37/234 |
| 5,353,530 | A | | 10/1994 | Pieper | |
| 5,568,694 | A | | 10/1996 | Capra et al. | |
| 5,647,153 | A | | 7/1997 | Gervais | |
| 5,655,318 | A | * | 8/1997 | Daniels | 37/231 |
| RE35,700 | E | | 12/1997 | Watson et al. | |
| 5,697,172 | A | * | 12/1997 | Verseef | 37/232 |
| 5,706,591 | A | | 1/1998 | Wissmiller | |
| 5,806,213 | A | | 9/1998 | Doornek et al. | |
| 5,806,214 | A | | 9/1998 | Behrens et al. | |

(List continued on next page.)

OTHER PUBLICATIONS

Webpage from www.tocata.com, "Cut Your Plow Time in Half!", Back–Drag Plow Images, pp. 1–6, Dec. 27, 2000.

*Primary Examiner*—Victor Batson
(74) *Attorney, Agent, or Firm*—Reinhart Boerner Van Deuren s.c.

(57) ABSTRACT

An improved snow plow for use with light and medium duty trucks is disclosed which has blade trip springs which are mounted using brackets located to direct the force of the springs in directions which are orthogonal to the axis upon which the plow blade pivots, thereby increasing the predictability of the tripping forces exerted by the trip springs as well as eliminating lateral trip spring forces which could warp the plow blade. The forces exerted by the trip springs are exerted proximate planes which are orthogonal to the pivot points at which the snow plow blade is mounted to the snow plow blade support structure. Either a single trip spring on either side of the snow plow blade or two trip springs on each side of the snow plow blade may be used, and the size of the trip springs is minimized by ensuring that all of the forces which they exert are directed properly in the requisite directions.

20 Claims, 19 Drawing Sheets

U.S. PATENT DOCUMENTS 5,815,956 A 10/1998 Lavin et al.
5,829,174 A * 11/1998 Hadler et al. ..... 37/234
5,870,839 A 2/1999 Wissmiller
5,930,922 A * 8/1999 Altheide ..... 37/268
5,960,569 A * 10/1999 Molstad ..... 37/231
6,012,240 A 1/2000 Klug et al.
6,050,008 A 4/2000 Doornek et al.
6,074,120 A 6/2000 Williams
6,145,222 A 11/2000 Curtis
6,151,808 A 11/2000 Curtis
6,170,178 B1 1/2001 Christy
6,178,669 B1 1/2001 Quenzi et al.
6,209,231 B1 4/2001 Curtis
6,219,943 B1 4/2001 Kitchell
6,240,659 B1 6/2001 Curtis et al.
6,276,075 B1 8/2001 Kost et al.
6,276,076 B1 8/2001 Quenzi et al.
6,354,024 B1 3/2002 Kost et al.
6,363,629 B1 4/2002 Curtis
6,381,880 B1 5/2002 Curtis
6,393,737 B2 5/2002 Quenzi et al.
6,408,546 B2 6/2002 Curtis

* cited by examiner

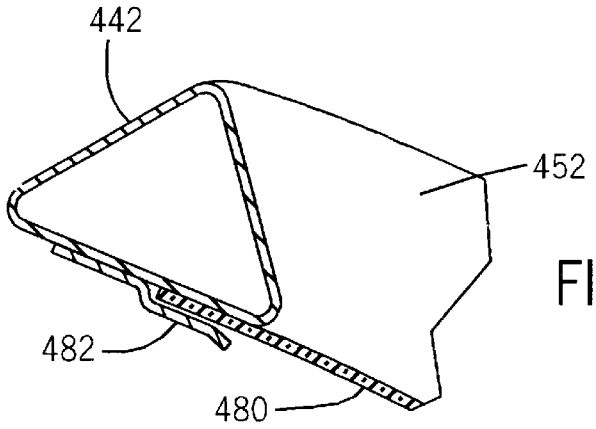
FIG. 13
FIG. 15
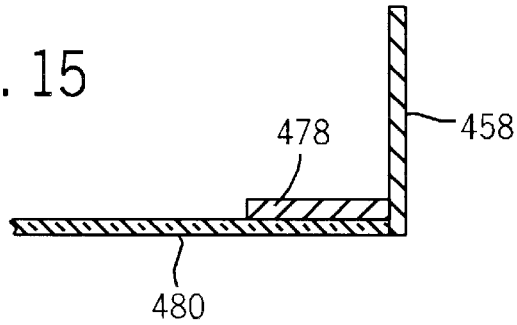
FIG. 14
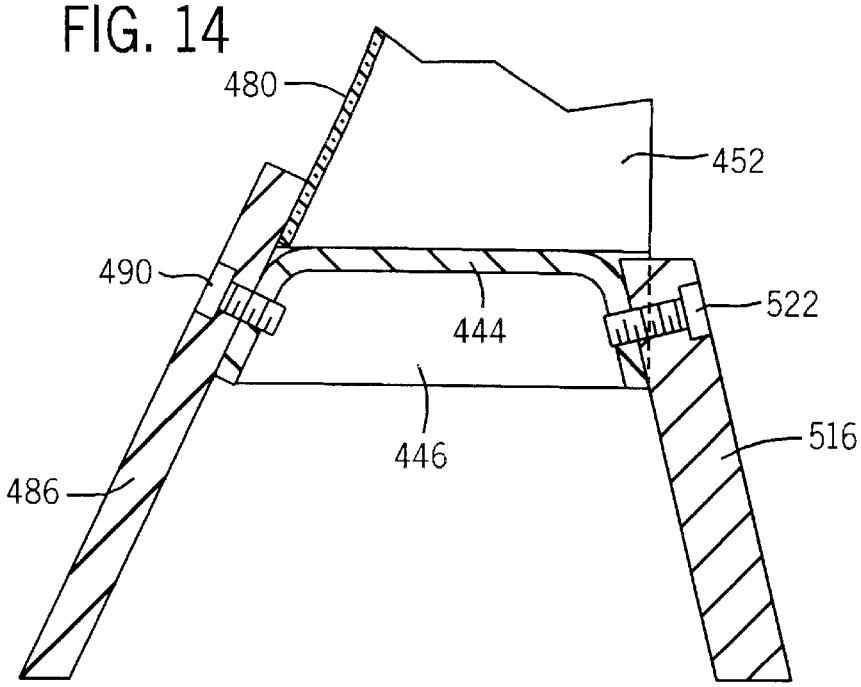

SPRING BRACKET DESIGN AND METHOD FOR SNOW PLOW BLADE TRIPPING MECHANISM

IDENTIFICATION OF RELATED PATENT APPLICATIONS

This application is related to four other concurrently filed copending patent applications, namely U.S. patent application Ser. No. 10/192,336, entitled "Snow Plow Quick Connect/Disconnect Hitch Mechanism and Method," U.S. patent application Ser. No. 10/192,225, entitled "Snow Plow Having an In-Line Frame Design and Method of Making the Same," U.S. patent application Ser. No. 10/192.224, entitled "Cushion Stop and Method for Absorbing Bidirectional Impact of Snow Plow Blade Tripping," U.S. patent application Ser. No. 10/192,230, entitled "Back Blade Wearstrip for Efficient Backward Operation of Snow Plows and Method for Facilitating the Same," all assigned to the assignee of the present patent application, which four patent applications are hereby incorporated herein by reference.

BACKGROUND OF THE INVENTION

Field of the Invention

The present invention relates generally to snow plows for use with light and medium duty trucks, and more particularly to an improved snow plow with blade trip springs which are mounted using brackets located to direct the forces of the springs in directions which are orthogonal to the axis upon which the plow blade pivots, thereby increasing the predictability of the tripping forces exerted by the trip springs as well as eliminating lateral trip spring forces which could warp the plow blade.

Once the exclusive domain of municipality-operated heavy trucks, snow plows have been used with light and medium duty trucks for decades. As would be expected in any area of technology which has been developed for that period of time, snow plows for light and medium duty trucks have undergone tremendous improvement in a wide variety of ways over time, evolving to increase both the usefulness of the snow plows as well as to enhance the ease of using them. The business of manufacturing snow plows for light and medium duty trucks has been highly competitive, with manufacturers of competing snow plows differentiating themselves based on the features and enhanced technology that they design into their products.

When plowing snow, a not infrequent occurrence is striking an object which is concealed beneath the snow. This occurs particularly often when plowing roads which are not paved, such as, for example, gravel roads or dirt roads. Since roads being plowed are typically frozen, it is common for an object of significant size to become frozen into the road. For example, medium size rocks or sticks which would not present a significant obstacle were they loose on the surface of the road can present a problem when they are frozen into the surface of the road and concealed beneath a layer of snow. In addition, when significant snow depth covers the area being plowed, the operator may miscalculate and drive the snow plow into a fixed obstacle such as a curb.

For this reason, snow plow blades have been manufactured for some time with a blade trip mechanism which allows the bottom of the blade to yield upon substantial impact. This is typically accomplished through the mounting of the snow plow blade on its support structure using a pivoting mechanism. The snow plow blade is mounted onto the support structure at a position between eight and sixteen inches above the ground in a manner which permits the bottom of the snow plow blade to pivot back when an object is struck. Simultaneously as the bottom of the snow plow blade pivots back, the top of the snow plow blade will pivot forward.

This movement between the normal plowing position of the snow plow blade to the position in which the bottom of the snow plow blade pivots fully backward is referred to as blade tripping. The movement of the snow plow blade from the normal plowing position to the tripped position is resisted by two or more strong trip springs which are mounted behind the snow plow blade, typically running from positions near the top of the snow plow blade to the snow plow blade support structure. Even when the snow plow blade is in its normal plowing position, the trip springs are under tension. Accordingly, it will be appreciated that when the bottom of the snow plow blade is forced backward, the trip springs will provide a strong resistance to the movement, tending to absorb some of the force of the impact of the snow plow blade with the object which has been struck.

In a typical embodiment, the snow plow blade is supported at two pivot points on the right and left sides of the snow plow blade by a swing frame. The snow plow blade has a plurality of vertically extending curved ribs which are connected between top and bottom plow frame members, and two of these ribs have apertures located between approximately eight and sixteen inches from the bottom of the snow plow blade. The snow plow blade is pivotally mounted to the swing frame using these apertures. The trip springs are mounted between the snow plow blade and the swing frame to provide the tripping resistance force.

The trip springs are mounted to the snow plow blade using apertures located either in the ribs or in the top frame member, or using brackets mounted onto one or more of these members. The trip springs may be mounted at one end to the top frame member and the ribs from which the snow plow blade is pivotally supported. The other ends of each of the trip springs are mounted to the snow plow blade support structure, typically using brackets which may be mounted, for example, on the swing frame. The points of connection of the trip springs on the swing frame or other snow plow blade support structure are typically located closer to the center of the snow plow than is the point of connection of the trip springs to the snow plow blade.

Although the predominant force exerted by the trip springs on the snow plow blade is orthogonal to the axis on which the snow plow blade pivots, a significant portion of the force is exerted in a lateral direction which is parallel to that axis. This component of the spring force is detrimental to the structural integrity of the snow plow blade frame, which is not constructed to resist forces in a lateral direction. Although the trip springs are located on both sides of the snow plow blade, and the lateral forces exerted by them thus tend to offset, over time their presence can cause blade distortion or other damage. In addition, it will be appreciated by those skilled in the art that since not all of the force exerted by the trip springs is in the direction orthogonal to the axis on which the snow plow blade pivots, the trip springs must be larger in order to provide the desired force in this orthogonal direction than they would otherwise be if all of the force which they exerted were in this orthogonal direction.

It is accordingly the primary objective of the present invention that it mount the trip springs on a snow plow in a manner whereby all of the force exerted by the trip springs is exerted in a direction which is orthogonal to the axis about which the snow plow blade pivots. It is a closely related objective of the present invention that it provide mounting brackets which facilitate the mounting of the trip springs in a manner which eliminates the exertion of any lateral force by the trip springs. It is a further related objective of the present invention that it minimize the size of the trip springs by ensuring that all of the force which they exert is directed properly to provide the required force in the requisite direction.

It is another primary objective of the present invention that the force exerted by the trip springs is exerted proximate a plane which is orthogonal to the pivot points at which the snow plow blade is mounted to the snow plow blade support structure. It is a related objective that the force of the trip springs is exerted on appropriate areas of the snow plow blade so that any potential distortion of the snow plow blade is inhibited. It is a further objective of the present invention that it facilitate the use of either a single trip spring on either side of the snow plow blade or two trip springs on each side of the snow plow blade.

The snow plow trip spring mount of the present invention must also be of a construction which is both durable and long lasting, and it should also require little or no maintenance to be provided by the user throughout its operating lifetime. In order to enhance the market appeal of the snow plow trip spring mount of the present invention, it should also be of inexpensive construction to thereby afford it the broadest possible market. Finally, it is also an objective that all of the aforesaid advantages and objectives of the snow plow trip spring mount of the present invention be achieved without incurring any substantial relative disadvantage.

SUMMARY OF THE INVENTION

The disadvantages and limitations of the background art discussed above are overcome by the present invention. With this invention, the trip springs which control the tripping action of the snow plow blade are each mounted such that they exert force only in a plane which is perpendicular to the axis of rotation of the snow plow blade's tripping movement. The snow plow blade itself is supported at two pivot points on the right and left sides of the snow plow blade by a swing frame, and the trip springs are each mounted between the swing frame and the snow plow blade.

The snow plow blade has a plurality of vertically oriented curved ribs which are connected between top and bottom plow frame members, and two of these ribs have apertures located between approximately eight and sixteen inches from the bottom of the snow plow blade. The swing frame itself is based upon a rectangular steel swing frame tube, which has a pivot made of steel tubing extending between two opposite sides of the swing frame in a location intermediate the ends of the swing frame. The swing frame will be pivotally supported by a snow plow frame, which in turn will be mounted onto the front of a truck. The swing frame has a pair of parallel blade pivot mounts located at each end thereof, which blade pivot mounts extend forwardly from a swing frame tube upon which they are mounted.

Located near the front of each of the blade pivot mounts are apertures which are aligned in each pair of blade pivot mounts. Each pair of blade pivot mounts will receive a portion of one of the ribs on the snow plow frame which have the apertures therein, with one of the blade pivot mounts in each pair being located on either side of the rib to which that side of the swing frame is being mounted. A pin extends through the aligned apertures on each side of the snow plow blade to pivotally mount it on the swing frame.

Located on the swing frame near each of the ends thereof is a bracket for mounting one end of one or two trip springs, the other ends of which trip springs will be mounted to corresponding brackets which are mounted onto the frame of the snow plow blade. In the preferred embodiment, the brackets on the swing frame are mounted on the blade pivot mounts, and the brackets on the snow plow blade are mounted on the ribs of the snow plow blade which are pivotally mounted to the blade pivot mounts on the swing frame. Since these brackets are aligned with each other, the trip springs mounted between the corresponding pairs of brackets will be oriented front to rear, and as such will not exert any lateral pull on the snow plow blade.

In the preferred embodiment, two trip springs are mounted at each side of the snow plow blade. Alternately, a single trip spring may instead be used on each side of the snow plow blade. As the snow plow blade pivots between its trip return position and its tripped position, the trip springs always exert force only within a plane which is parallel to the axis of the pivoting movement of the snow plow blade.

It may therefore be seen that the present invention teaches an apparatus and method for mounting the trip springs on a snow plow in a manner whereby all of the force exerted by the trip springs is exerted in a direction which is orthogonal to the axis about which the snow plow blade pivots. The mounting brackets of the present invention facilitate the mounting of the trip springs in a manner which eliminates the exertion of any lateral force by the trip springs. The size of the trip springs required by the present invention is minimized by ensuring that all of the force which they exert is directed properly to provide the required force in the requisite direction.

The force exerted by the trip springs of the snow plow trip spring mount of the present invention is exerted proximate a plane which is orthogonal to the pivot points at which the snow plow blade is mounted to the snow plow blade support structure. In addition, the force of the trip springs is exerted on appropriate areas of the snow plow blade so that any potential distortion of the snow plow blade is inhibited. The snow plow trip spring mount of the present invention facilitates the use of either a single trip spring on either side of the snow plow blade or two trip springs on each side of the snow plow blade.

The snow plow trip spring mount of the present invention is of a construction which is both durable and long lasting, and which will require little or no maintenance to be provided by the user throughout its operating lifetime. The snow plow trip spring mount of the present invention is also of inexpensive construction to enhance its market appeal and to thereby afford it the broadest possible market. Finally, all of the aforesaid advantages and objectives of the snow plow trip spring mount of the present invention are achieved without incurring any substantial relative disadvantage.

DESCRIPTION OF THE DRAWINGS

These and other advantages of the present invention are best understood with reference to the drawings, in which:

FIG. 13 is a partial cross-sectional view of the top of the plow blade illustrated in FIG. 11, showing how the top of the moldboard is retained by the plow blade frame;

FIG. 14 is a partial cross-sectional view of the bottom of the plow blade illustrated in FIG. 11, showing how the bottom of the moldboard is retained by the plow blade frame and the plow cutting edge;

FIG. 15 is a partial cross-sectional view of a side edge of the plow blade illustrated in FIG. 11, showing how the side of the moldboard is retained by the plow blade frame;

DESCRIPTION OF THE PREFERRED EMBODIMENT

Figure 25:
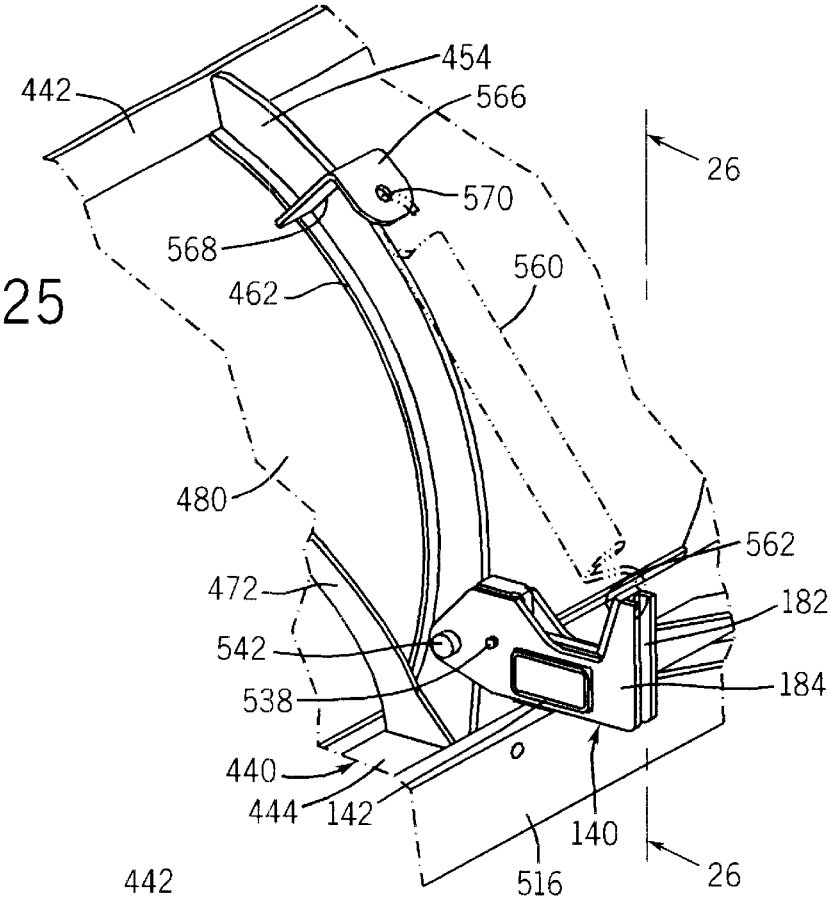
FIG. 25 is a perspective view of an alternate embodiment similar to the view shown in FIG. 23, but with a single spring mount on one side of the plow blade and the plow swing frame, and also showing a spring in phantom lines.
Figure 26:
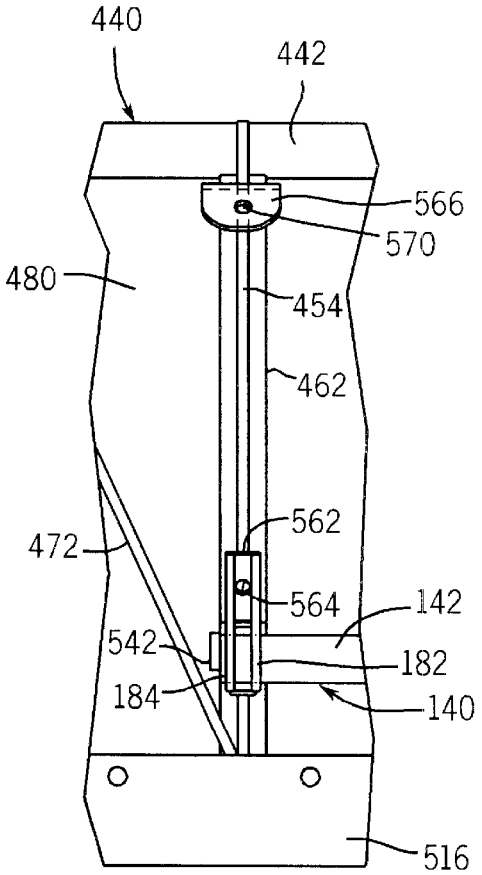
FIG. 26 is a partial rear plan view of plow blade, the plow swing frame, and the spring mount illustrated in FIG. 25.

The preferred embodiment of the present invention is illustrated in a series of figures, of which the FIGS. 1 through 9 and 11 are components of the snow plow which embodies the present invention. FIGS. 10, 12 through 24, and 27 through 29 illustrate the assembly of the snow plow embodying the present invention, and FIGS. 30 through 37 illustrate the manner in which the snow plow is attached to the hitch. Finally, FIGS. 25, 26, and 38 illustrate two alternate embodiments. The snow plow of the present invention includes five novel aspects: a novel frame design which has a lower profile and an enhanced linear strength which is attained by that design; a novel hitch quick connect, quick release design; a novel plow blade trip spring placement; a novel plow blade stop design which uses replaceable cushion stop blocks to absorb the impact of plow blade movement between extreme positions; and a novel back blade wearstrip which allows the plow blade to be used to plow backward as well as forward.

Figure 1:
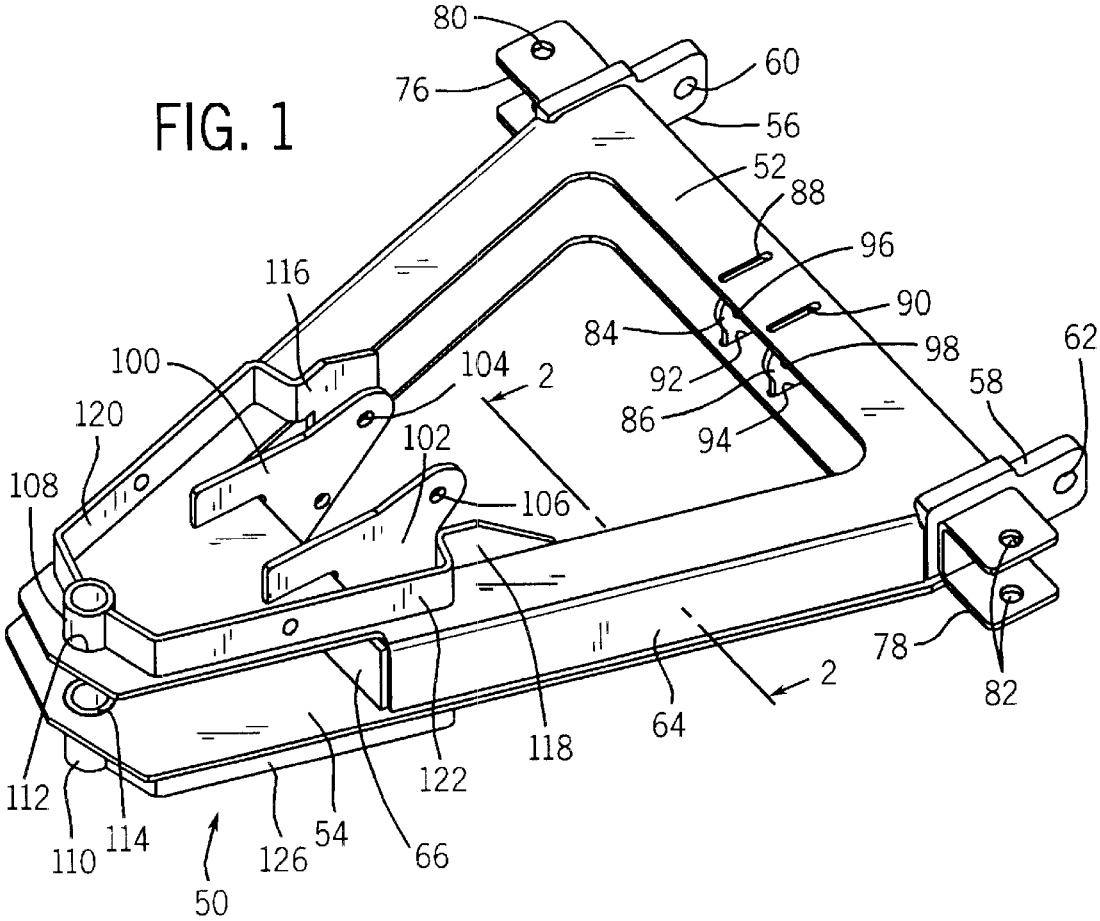
FIG. 1 is a perspective view of a plow A-frame.
Figure 2:
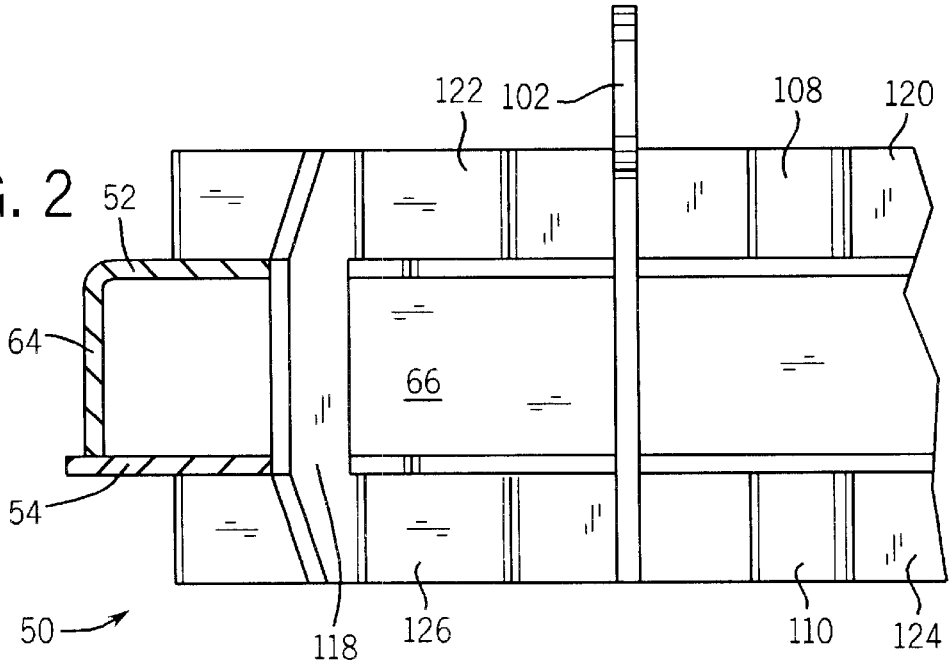
FIG. 2 is a partial cross-sectional view of the plow A-frame illustrated in FIG. 1.

The first of these five novel aspects of the snow plow of the present invention resides in the innovative design of its two-piece frame. Referring first to FIGS. 1 and 2, the first of these two pieces, a plow A-frame 50, is illustrated. The plow A-frame 50 as illustrated in FIG. 2 has its front end shown at the left of FIG. 2 and its rear end shown at the right of FIG. 2, and is symmetric around an axis running from the front to the rear thereof. The plow A-frame 50 tapers from a narrower width at the front thereof to a wider width at the rear thereof.

The basic shape of the plow A-frame 50 is formed by a top plate 52 and a bottom plate 54, which are essentially parallel and are spaced apart from each other. The configurations of the top plate 52 and the bottom plate 54 as viewed from the top (or from the bottom) resemble a portion of the capital letter "A," with the portions of the sides of the "A" above the crossbar of the "A" being absent. There is a large aperture extending through each of the top plate 52 and the bottom plate 54 above the crossbar of the "A," which apertures resemble an isosceles trapezoid. The top plate 52 and the bottom plate 54 are preferably made of steel plate.

Mounted between the sides of the top plate 52 and the bottom plate 54 at the location of the crossbar of the "A" and extending rearwardly so as to resemble abbreviated legs of the "A" below the crossbar are two lugs 56 and 58 made of flat bar stock. The lugs 56 and 58 are also preferably made of steel, and are welded onto the sides of the top plate 52 and the bottom plate 54. The portion of the lug 56 which extends rearwardly from the top plate 52 and the bottom plate 54 has an aperture 60 extending therethrough, and the portion of the lug 58 which extends rearwardly from the top plate 52 and the bottom plate 54 has an aperture 62 extending therethrough.

Portions of three sides of the top plate 52 are bent downwardly at a ninety degree angle to extend to the top of the bottom plate 54. Only one of these sides, a left side 64, is visible in FIGS. 1 and 2. The left side 64 of the top plate 52 extends from just in front of the lug 58, and extends approximately two-thirds of the way toward the front end of the plow A-frame 50. A right side of the top plate 52 (which is the mirror image of the left side 64 of the top plate 52) and a rear side of the top plate 52 extending between the lugs 56 and 58 are also bent downwardly at ninety degree angles to extend to the top of the bottom plate 54. These three sides are all welded to the bottom plate 54 to create a box-like structure. A rectangular plate 66 is located just in front of the isosceles trapezoid-shaped apertures in the top plate 52 and the bottom plate 54, and extends between the sides of the top plate 52 and the bottom plate 54. The rectangular plate 66 is also preferably made of steel, and all four sides of the rectangular plate 66 are welded onto the top plate 52 (including the left side 64 and right side thereof) and the bottom plate 54 to provide the fourth side of the box-like structure.

Extending from the sides of the lugs 56 and 58 are U-shaped swing cylinder mounts 76 and 78, respectively. The swing cylinder mounts 76 and 78 are also preferably made of steel, and are welded onto the lugs 56 and 58, respectively, with the legs of the U's of the swing cylinder mounts 76 and 78 being located on the top and the bottom of the plow A-frame 50. An aperture 80 is located in each leg of the U in the swing cylinder mount 76, and an aperture 82 is similarly located in each leg of the U in the swing cylinder mount 78.

Located between the rear of the top plate 52 at the location of the crossbar of the "A" and the rear of the bottom plate 54 at the location of the crossbar of the "A" are two lift cylinder mounts 84 and 86. The cylinder mounts 84 and 86 are parallel both to each other and to the plane which divides the plow A-frame 50 into left and right sides thereof. The cylinder mounts 84 and 86 each extend from slots 88 and 90, respectively, located in the crossbar of the "A" of the top plate 52 and slots 92 and 94, respectively, located in the crossbar of the "A" of the bottom plate 54. The cylinder mounts 84 and 86 are also preferably made of steel, and their ends are welded into the slots 88 and 90, respectively, in the top plate 52 and the slots 92 and 94, respectively, in the bottom plate 54. The cylinder mounts 84 and 86 each have an aperture 96 or 98, respectively, located therein which apertures 96 and 98 are coaxial.

Located at the top of the aperture in the "A" in the plow A-frame 50 are two parallel, spaced-apart, pivot mount plates 100 and 102. The pivot mount plates 100 and 102 are also preferably made of steel, and are welded onto the rectangular plate 66, the portion of the top plate 52 adjacent thereto, and the portion of the bottom plate 54 adjacent thereto. The pivot mount plates 100 and 102 are mounted on opposite sides of the centerline of the plow A-frame 50, and extend rearwardly and upwardly from the rectangular plate 66, and are beneath a portion of the bottom plate 54. Located near the rearmost and uppermost ends of the pivot mount plates 100 and 102 are apertures 104 and 106, respectively, which are coaxial.

Mounted near the front of the plow A-frame 50 are two hollow cylindrical swing frame pivots 108 and 110. The swing frame pivots 108 and 110 are centrally mounted near the front end of the plow A-frame 50 in apertures 112 and 114, respectively, which are located in the top plate 52 and the bottom plate 54, respectively. The swing frame pivots 108 and 110 are also preferably made of steel, and are welded into the apertures 112 and 114, respectively. The swing frame pivots 108 and 110 are coaxial and are orthogonal to the top plate 52 and the bottom plate 54.

Located on the inside of each of the legs of the "A" of the plow A-frame 50 near to the top of the "A" are two support sides 116 and 118. The support sides 116 and 118 extend perhaps one-fourth of the way from the top of the opening of the "A" toward the crossbar of the "A." The ends of the support sides 116 and 118 oriented closest to the crossbar of the "A" extend between the top side of the top plate 52 and the bottom side of the bottom plate 54, and the support sides 116 and 118 increase in height above the top plate 52 and below the bottom plate 54 as the support sides 116 and 118 extend towards the front of the plow A-frame 50. The support sides 116 and 118 are preferably made of steel, and are welded to the top plate 52, the bottom plate 54, and the rectangular plate 66.

Four U-shaped ribs 120, 122, 124, and 126 extend between the support sides 116 and 118 and the swing frame pivots 108 and 110. The bases of the "U" of each of the U-shaped ribs 120, 122, 124, and 126 are much wider than the legs of the "U" are tall. The U-shaped ribs 120 and 122 are mounted on top of the top plate 52, and the bases of the "U's" of the U-shaped ribs 120 and 122 are located close adjacent the right and left sides, respectively, of the top plate 52. The U-shaped rib 124 and 126 are mounted on the bottom of the bottom plate 54, and the bases of the "U's" of the U-shaped ribs 124 and 126 are located close adjacent the right and left sides, respectively, of the bottom plate 54. In the preferred embodiment, the U-shaped rib 120, the support side 116, and the U-shaped rib 124 are manufactured as a single component, and likewise the U-shaped rib 122, the support side 118, and the U-shaped rib 126 are also manufactured as a single component.

One leg of the U-shaped rib 120 extends between the base of the "U" and the support side 116, and the other leg of the U-shaped rib 120 extends between the base of the "U" and the swing frame pivot 108. One leg of the U-shaped rib 122 extends between the base of the "U" and the support side 118, and the other leg of the U-shaped rib 122 extends between the base of the "U" and the swing frame pivot 108. One leg of the U-shaped rib 124 extends between the base of the "U" and the support side 116, and the other leg of the U-shaped rib 124 extends between the base of the "U" and the swing frame pivot 110. One leg of the U-shaped rib 126 extends between the base of the "U" and the support side 118, and the other leg of the U-shaped rib 126 extends between the base of the "U" and the swing frame pivot 110.

The U-shaped ribs 120, 122, 124, and 126 are preferably made of steel, and the U-shaped ribs 120 and 122 are welded onto the top plate 52, while the U-shaped ribs 124 and 126 are welded onto the bottom of the bottom plate 54. As mentioned above, the U-shaped ribs 120 and 124 may be made integrally with the support side 116, while the U-shaped rib 122 and 126 may be made integrally with the support side 118. The swing frame pivots 108 and 110 define an axis upon which a swing frame which will be described below in conjunction with FIGS. 3 through 5 will be mounted, and the area between the top plate 52 and the bottom plate 54 and in front of the rectangular plate 66 is the area in which the swing frame will be mounted.

Figure 3:
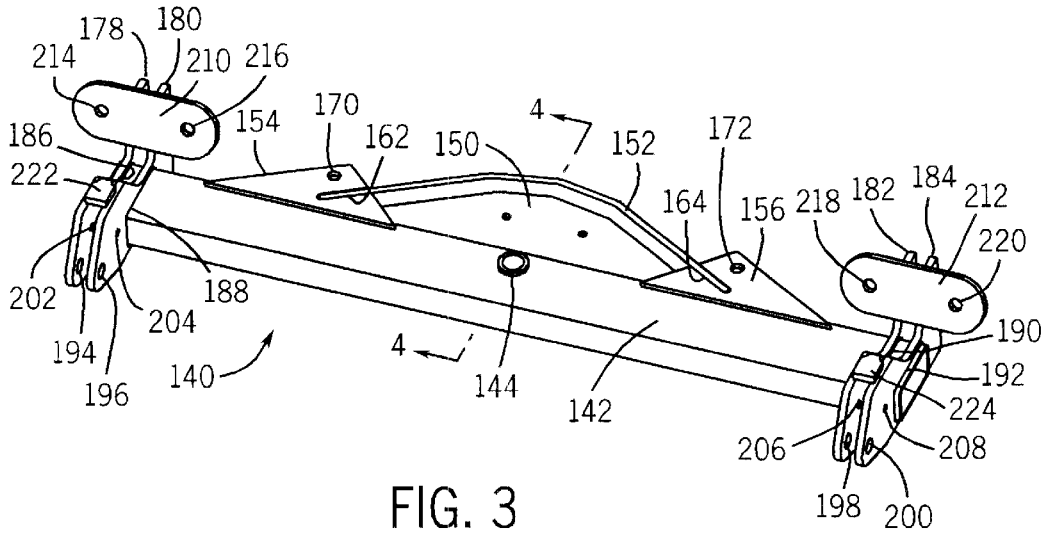
FIG. 3 is a perspective view of a plow swing frame which will be pivotally mounted on the front end of the plow A-frame illustrated in FIGS. 1 and 2 and which will support a plow blade therefrom.
Figure 4:
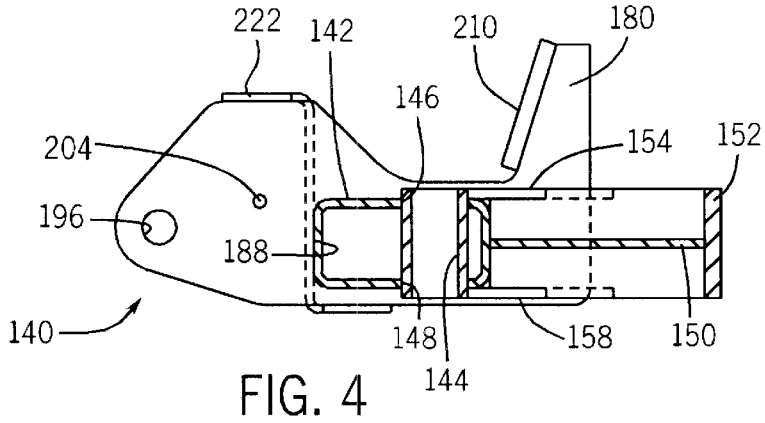
FIG. 4 is a cross-sectional view of the plow swing frame illustrated in FIG. 3.
Figure 5:
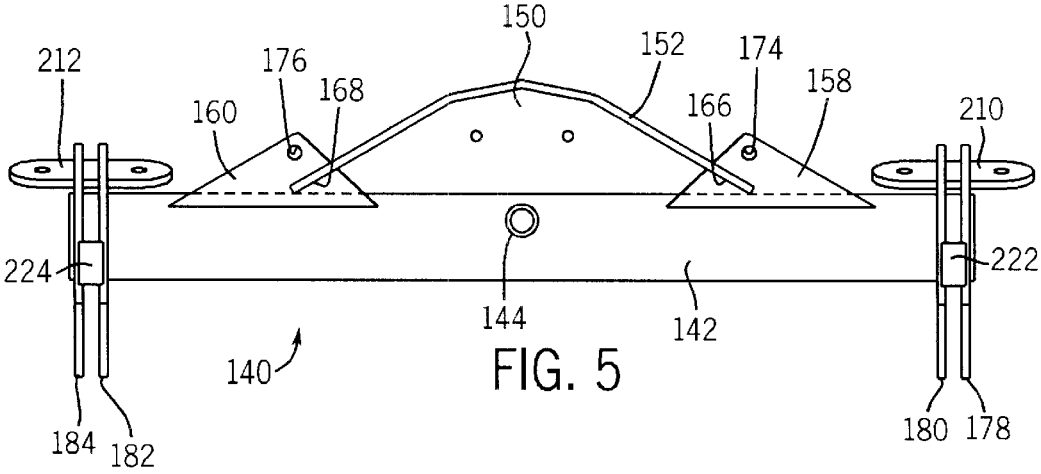
FIG. 5 is a bottom plan view of the plow swing frame illustrated in FIGS. 3 and 4.

Referring next to FIGS. 3 through 5, a swing frame 140 is illustrated which will be mounted as described above on the plow A-frame 50 (illustrated in FIGS. 1 and 2). The swing frame 140 is based upon a rectangular swing frame tube 142 having a hollow cylindrical pivot 144 extending through the thinner cross section thereof at the midpoint of the length of the rectangular swing frame tube 142. The rectangular swing frame tube 142 has an aperture 146 located in the top side thereof and another aperture 148 located in the bottom side thereof. The apertures are closer to the rear side of the rectangular swing frame tube 142 than they are to the front side thereof. Both the rectangular swing frame tube 142 and the pivot 144 are preferably made of steel, and the pivot 144 is welded to the rectangular swing frame tube 142. The pivot 144 extends slightly above and below the top and bottom, respectively, of the rectangular swing frame tube 142.

A guide plate 150 extends from the rear of the rectangular swing frame tube 142. The guide plate 150 is shaped like an isosceles trapezoid with a low triangle mounted on the top thereof, with the base of the isosceles trapezoid mounted onto the rectangular swing frame tube 142. The width of the guide plate 150 is perhaps half of the length of the rectangular swing frame tube 142, and the guide plate 150 is centrally mounted both as to the length of the rectangular swing frame tube 142 and as to its height as well. The guide plate 150 is preferably also steel, and is welded onto the rectangular swing frame tube 142.

Mounted on the rear edge of the guide plate 150 is a guide/stop bar 152 which is made of a segment of flat stock which is wider than the height of the rectangular swing frame tube 142. The guide/stop bar 152 is bent to conform to the guide plate 150, and its ends contact the rear side of the rectangular swing frame tube 142. The guide plate 150 and the guide/stop bar 152 together form a T-shaped configuration in cross-section, as best shown in FIG. 4. The guide/stop bar 152 thus extends both slightly above and slightly below the rectangular swing frame tube 142, as is also best shown in FIG. 4. The guide/stop bar 152 is preferably made of steel, and is welded onto the guide plate 150, with the ends of the guide/stop bar 152 being welded onto the rear of the rectangular swing frame tube 142. When the swing frame 140 is mounted onto the plow A-frame 50 (illustrated in FIGS. 1 and 2), the guide/stop bar 152 will contact the rectangular plate 66 when the swing frame 140 is rotated between its extreme positions, with the guide/stop bar 152 thus acting to prevent rotation of the swing frame 140 in either direction beyond these positions.

Four triangular swing cylinder mounting plates 154, 156, 158, and 160 are mounted onto the rectangular swing frame tube 142 at positions approximately halfway between the center and the ends of the rectangular swing frame tube 142, and project rearwardly. The swing cylinder mounting plates 154 and 156 are mounted on the top of the rectangular swing frame tube 142 near the rear edge thereof and the right and left sides thereof, respectively. The swing cylinder mounting plates 158 and 160 are mounted on the bottom of the rectangular swing frame tube 142 near the rear edge thereof and the right and left sides thereof, respectively. The swing cylinder mounting plates 154, 156, 158, and 160 are preferably made of steel, and are welded onto the rectangular swing frame tube 142.

The swing cylinder mounting plates 154, 156, 158, and 160 each have a slot 162, 164, 166, or 168, respectively, cut therein to receive an end of the guide/stop bar 152. The ends of the guide/stop bar 152 fit into these slots 162, 164, 166, or 168 and are welded therein. Located in each of the swing cylinder mounting plates 154, 156, 158, and 160 near the rearmost corner thereof is an aperture 170, 172, 174, or 176, respectively. The apertures 170 and 174 are coaxial, and the apertures 172 and 176 are coaxial.

Four blade pivot mounts 178, 180, 182, and 184 are mounted on the rectangular swing frame tube 142 in spaced-apart pairs located at each end thereof. The blade pivot mounts 178, 180, 182, and 184 have rectangular apertures 186, 188, 190, and 192, respectively, extending therethrough to receive therein the rectangular swing frame tube 142. The blade pivot mount 178 is mounted at the end of the rectangular swing frame tube 142 which will be on the right when the swing frame 140 is mounted on the plow A-frame 50 (illustrated in FIGS. 1 and 2), and the blade pivot mount 180 is spaced away from the blade pivot mount 178 on the rectangular swing frame tube 142.

Similarly, the blade pivot mount 184 is mounted at the end of the rectangular swing frame tube 142 which will be on the left when the swing frame 140 is mounted on the plow A-frame 50, and the blade pivot mount 182 is spaced away from the blade pivot mount 184 on the rectangular swing frame tube 142. The spacing between the blade pivot mount 178 and the blade pivot mount 180, and between the blade pivot mount 182 and the blade pivot mount 184 is sufficient to admit cushion stops which will be discussed below in conjunction with FIG. 19. The blade pivot mounts 178, 180, 182, and 184 are preferably also made of steel, and are welded onto the rectangular swing frame tube 142.

It should be noted that the blade pivot mounts 178, 180, 182, and 184 are identical in construction, with each extending forwardly in front of the rectangular swing frame tube 142 (as best shown in FIG. 4) and rearwardly and upwardly behind the rectangular swing frame tube 142. Located near the front of the blade pivot mounts 178, 180, 182, and 184 are apertures 194, 196, 198, and 200, respectively, which will be used to pivotally mount the snow plow blade (illustrated below in FIG. 11). The apertures 194, 196, 198, and 200 are coaxial. Located in the blade pivot mounts 178, 180, 182, and 184 intermediate the apertures 194, 196, 198, and 200, respectively, and the front of the rectangular swing frame tube 142 are apertures 202, 204, 206, and 208, respectively, which will be used to retain cushion stops which will be discussed below in conjunction with FIG. 19. The pairs of apertures 202 and 204, and 206 and 208 are coaxial.

As mentioned above, each of the blade pivot mounts 178, 180, 182, and 184 also extends rearwardly of the rectangular swing frame tube 142, resembling the profile of a vertical tail fin of a plane as best shown in FIG. 4. Mounted to each pair of each pair of the blade pivot mounts 178 and 180, and 182 and 184, are two trip spring brackets 210 and 212. The trip spring brackets 210 and 212 are preferably also made of steel, are generally oval in configuration, and are mounted with the wider sides being oriented between the left and right sides of the swing frame 140. The trip spring bracket 210 is welded onto the blade pivot mounts 178 and 180, and the trip spring bracket 212 is welded onto the blade pivot mounts 182 and 184. The trip spring bracket 210 has apertures 214 and 216 disposed near opposite ends thereof, and similarly the trip spring bracket 212 has apertures 218 and 220 disposed near opposite ends thereof.

Completing the swing frame 140 are two additional components which are used both to act as a stop for rotational movement of the plow blade (which will be discussed below in conjunction with FIG. 11) as well as to help define an enclosure for the cushion stops (which will be discussed below in conjunction with FIG. 18). A stop 222 is mounted at the top of, intermediate, and at the bottom of the blade pivot mounts 178 and 180. The stop 222 extends rearwardly from a point above the apertures 202 and 204, drops down in front of the rectangular swing frame tube 142, and extends rearwardly below the rectangular swing frame tube 142 to a point halfway between the front edge of the rectangular swing frame tube 142 and the pivot 144.

Similarly, a stop 224 is mounted at the top of, intermediate, and at the bottom of the blade pivot mounts 182 and 184. The stop 224 extends rearwardly from a point above the apertures 206 and 208, drops down in front of the rectangular swing frame tube 142, and extends rearwardly below the rectangular swing frame tube 142 to a point halfway between the front edge of the rectangular swing frame tube 142 and the pivot 144. The stops 222 and 224 are both preferably also made of steel, and are welded to the blade pivot mount pairs 178 and 180, and 182 and 184, respectively.

Figure 6:
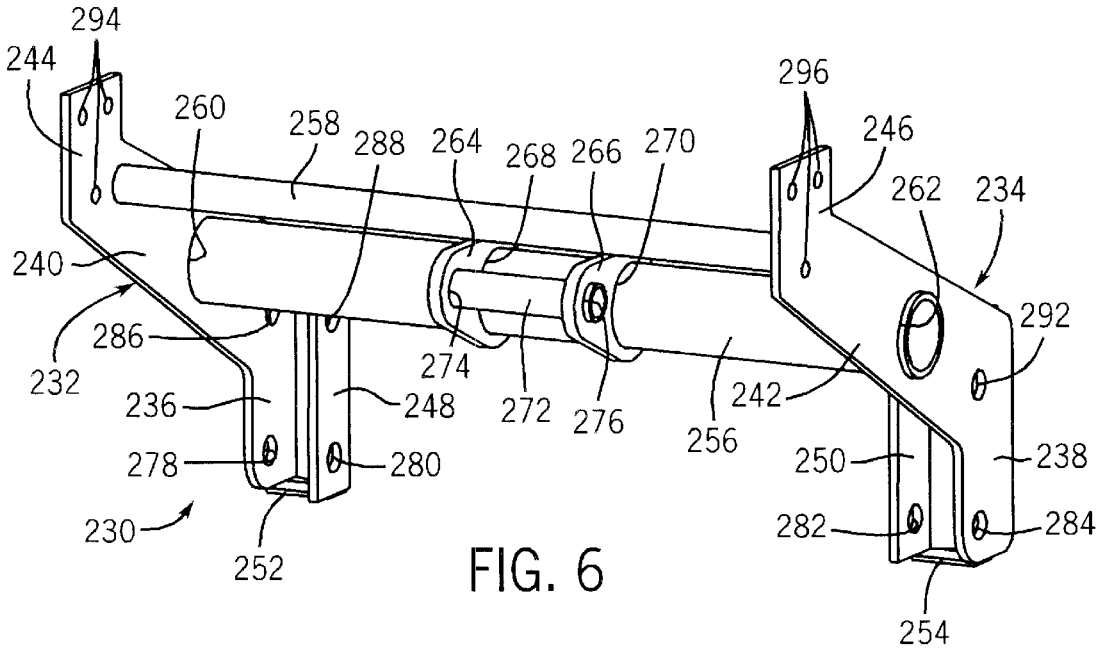
FIG. 6 is a perspective view of a pivoting lift bar which will be pivotally mounted at the rear end of the plow A-frame illustrated in FIGS. 1 and 2.

Referring next to FIG. 6, a lift bar 230 is illustrated which forms part of the hitch mechanism of the snow plow. The lift bar 230 has two lift bar support members 232 and 234, which are located on the right and left sides, respectively, of the lift bar 230. Each of the lift bar support members 232 and 234 has a configuration consisting of three segments: rear mounting supports 236 and 238, respectively, which extend upward vertically; central support arms 240 and 242, respectively, which extend forwardly and upwardly from the top of the rear mounting supports 236 and 238, respectively; and front light bar supports 244 and 246, respectively, which extend upwardly from the forwardmost and upwardmost ends of the central support arms 240 and 242, respectively. The lift bar support members 232 and 234 are preferably made of steel plate.

Extending inwardly from the rear sides of rear mounting supports 236 and 238 are segments of angled stock 248 and 250, respectively. It should be noted that the angle defined by each of the segments of angled stock 248 and 250 is less than ninety degrees, as, for example, approximately seventy degrees. The reason for this angle will become apparent below in conjunction with the discussion of FIGS. 31 and 32. The angled stock segments 248 and 250 are also preferably made of steel, and are welded onto rear mounting supports 236 and 238, respectively, so that the rear mounting supports 236 and 238 and the angled stock segments 248 and 250 together form vertically-oriented channels which are essentially U-shaped. Referring for the moment to FIG. 1 in addition to FIG. 6, the space between the rear mounting support 236 and the angled stock segment 248 of the lift bar 230 is designed to admit the lug 56 of the plow A-frame 50 with space between the lug 56 and the inside of the angled stock segment 248, and similarly the space between the angled stock segment 250, and the rear mounting support 238 of the lift bar 230 is designed to admit the lug 58 of the plow A-frame 50 with space between the lug 58 and the inside of the angled stock segment 250.

Referring again solely to FIG. 6, a rectangular reinforcing segment 252 (preferably also made of steel) is located at the bottom of the U-shaped channel formed by the rear mounting support 236 and the angled stock segment 248, and is welded to the bottoms of the rear mounting support 236 and the angled stock segment 248. Similarly, a rectangular reinforcing segment 254 (preferably also made of steel) is located at the bottom of the U-shaped channel formed by the rear mounting support 238 and the angled stock segment 250, and is welded to the bottoms of the rear mounting support 238 and the angled stock segment 250.

Not illustrated in the figures but used to reinforce the construction of the lift bar 230 are two additional rectangular reinforcing segments which are respectively located above the reinforcing segments 252 and 254. On the right side of the lift bar 230, the first of these additional reinforcing segments (preferably also made of steel) is located near the top of the U-shaped channel formed by the rear mounting support 236 and the angled stock segment 248, and is welded to the tops of the rear mounting support 236 and the angled stock segment 248. Similarly, the other of these reinforcing segments (preferably also made of steel) is located at near the top of the U-shaped channel formed by the rear mounting support 238 and the angled stock segment 250, and is welded to the tops of the rear mounting support 238 and the angled stock segment 250.

Extending between the lift bar support members 232 and 234 are a larger diameter hollow round upper pin support tube 256 and a smaller diameter round light bar brace 258. The upper pin support tube 256 and the light bar brace 258 are both also preferably made of steel. One end of the upper pin support tube 256 extends through an aperture 260 located in an intermediate position in the central support arm 240 of the lift bar support member 232, and the other end of the upper pin support tube 256 extends through an aperture 262 located in an intermediate position in the central support arm 242 of the lift bar support member 234. The ends of the upper pin support tube 256 are welded onto the central support arms 240 and 242. One end of the light bar brace 258 is welded onto the lift bar support member 232 at the intersection of the central support arm 240 and the light bar support 244, and the other end of the light bar brace 258 is welded onto the lift bar support member 234 at the intersection of the central support arm 242 and the light bar support 246.

Two upper pin hanger plates 264 and 266 are mounted on the upper pin support tube 256 in spaced-apart fashion near the middle of the upper pin support tube 256. The upper pin hanger plates 264 and 266 have apertures 268 and 270, respectively, extending therethrough near one end thereof, and the upper pin support tube 256 extends through these apertures 268 and 270. The upper pin hanger plates 264 and 266 are both also preferably made of steel, and are welded onto the upper pin support tube 256 in a manner whereby they are projecting forwardly. A tubular upper pin 272 extends through apertures 274 and 276 in the upper pin hanger plates 264 and 266, respectively, near the other end thereof. The upper pin 272 is also preferably made of steel, and is welded onto the upper pin hanger plates 264 and 266.

Located in the rear mounting support 236, the angled stock segment 248, the angled stock segment 250, and the rear mounting support 238 near the bottoms thereof are apertures 278, 280, 282, and 284, respectively, which are aligned with each other and which together define a pivot axis about which the lift bar 230 will pivot when it is mounted onto the plow A-frame 50 (Illustrated in FIG. 1). Located in the rear mounting support 236, the angled stock segment 248, the angled stock segment 250, and the rear mounting support 238 nearer the tops thereof than the bottoms thereof are apertures 286, 288, 290 (not shown in FIG. 6), and 292, which are aligned with each other.

The apertures 286 and 288 define a first location into which a retaining pin (not shown in FIG. 6) will be placed to mount the snow plow of the present invention onto a truck, and the apertures 290 and 292 define a second location into which another retaining pin (not shown in FIG. 6) will be placed to mount the snow plow of the present invention onto the truck. Located in the light bar support 244 are three apertures 294, and located in the light bar support 246 are three apertures 296. The apertures 294 and 296 will be used to mount a light bar (not illustrated in FIG. 6) onto the lift bar 230.

Figure 7:
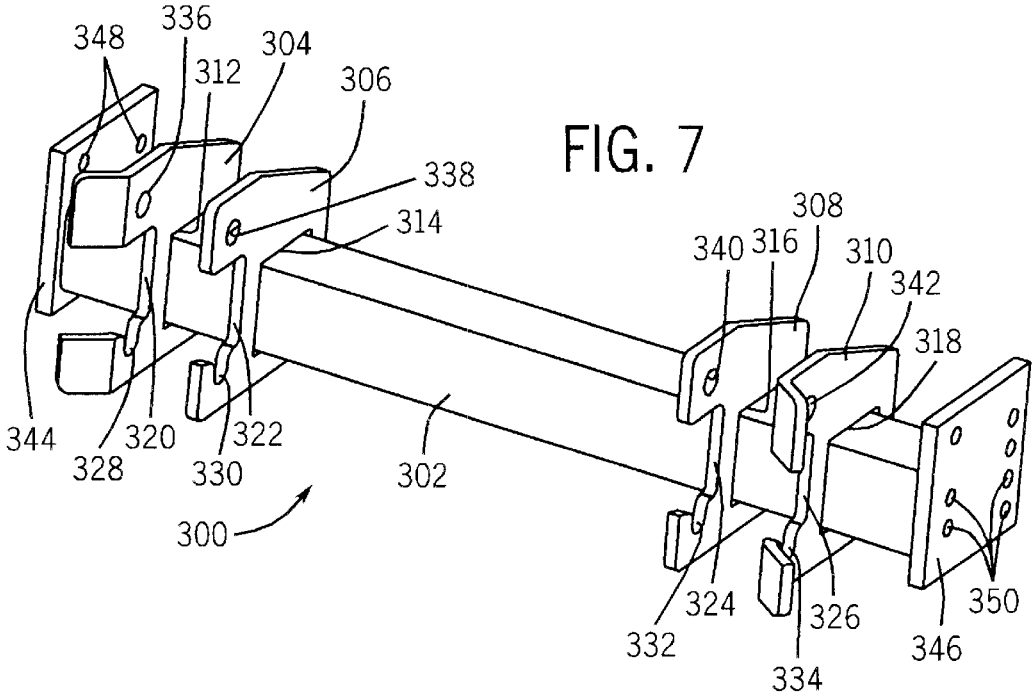
FIG. 7 is a perspective view of a hitch frame nose piece which will be mounted on a truck under the front bumper thereof.

Referring now to FIG. 7, a hitch frame nose piece 300 which will be mounted onto a truck under the front bumper (not illustrated in FIG. 7) thereof is illustrated. The hitch frame nose piece 300 has a square hitch frame tube 302 which is horizontally oriented. Four hitch brackets 304, 306, 308, and 310 are mounted on the square hitch frame tube 302 in spaced-apart pairs located nearer the ends of the square hitch frame tube 302 than the center thereof. The hitch brackets 304, 306, 308, and 310 have square apertures 312, 314, 316, and 318, respectively, extending therethrough to receive therein the square hitch frame tube 302. Both the square hitch frame tube 302 and the hitch brackets 304, 306, 308, and 310 are preferably made of steel, and the hitch brackets 304, 306, 308, and 310 are welded onto the square hitch frame tube 302.

Referring for the moment to FIG. 6 in addition to FIG. 7, the space between the hitch bracket 304 and the hitch bracket 306 of the hitch frame nose piece 300 is designed to admit the rear mounting support 236 and the angled stock segment 248 of the lift bar 230, and similarly the space between the hitch bracket 308 and the hitch bracket 310 of the hitch frame nose piece 300 is designed to admit the angled stock segment 250 and the rear mounting support 238 of the lift bar 230. The hitch brackets 304, 306, 308, and 310 have rectangular notches 320, 322, 324, and 326, respectively, cut into the front sides thereof.

Located in the hitch brackets 304, 306, 308, and 310 in the bottoms of the rectangular notches 320, 322, 324, and 326, respectively, are slots 328, 330, 332, and 334, respectively. The slots 328, 330, 332, and 334 have rounded bottoms, and are axially aligned. Also located in the hitch brackets 304, 306, 308, and 310 above the tops of the rectangular notches 320, 322, 324, and 326, respectively, are apertures 336, 338, 340, and 342, respectively. The apertures 336, 338, 340, and 342 are also axially aligned.

Unlike the hitch brackets 306 and 308 which are flat, the hitch brackets 304 and 310 have their forward-most portions flanged outwardly to act as guides to direct the lift bar 230 (illustrated in FIG. 6) into engagement with the hitch frame nose piece 300. Thus, the portions of the hitch brackets 304 and 310 at the front of the rectangular notches 320 and 326, respectively, extend outwardly, both on the top of the rectangular notches 320 and 326 and on the bottom of the rectangular notches 320 and 326. It should be noted that, if desired, the hitch brackets 304 and 310 may also be flat. The ramifications of having them flat instead of flanged will eliminate the utility of the right and left sides of the lift bar 230.

The respective ends of the square hitch frame tube 302 are mounted onto mounting plates 344 and 346. The mounting plates 344 and 346 are also preferably made of steel, and the ends of the square hitch frame tube 302 are welded onto the mounting plates 344 and 346. Located in the mounting plates 344 and 346 are a plurality of apertures 348 and 350, respectively, which will be used to mount the hitch frame nose piece 300 onto the frame of a truck (not shown in FIG. 7) using mounting brackets (not shown in FIG. 7) in a manner which is conventional.

Figure 8:
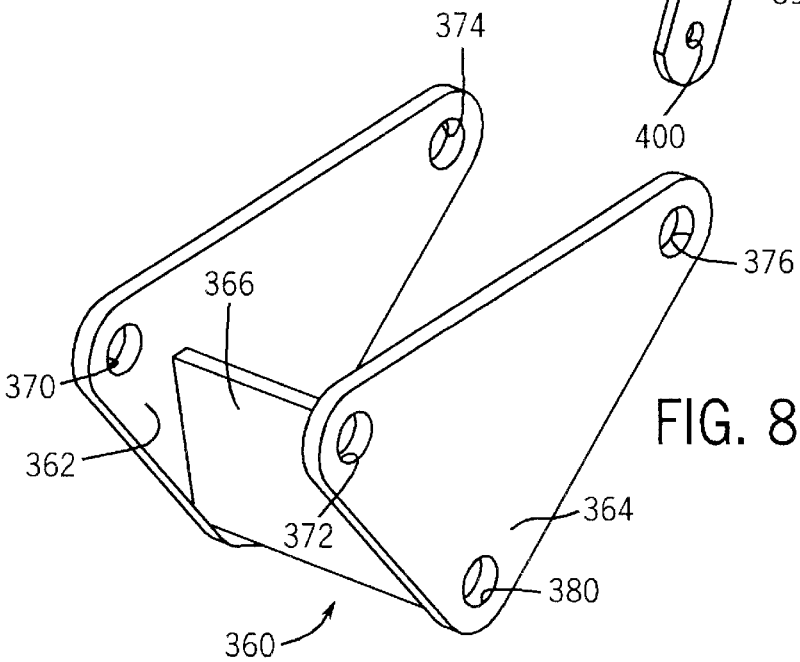
FIG. 8 is a perspective view of a bellcrank which is used to operate the pivoting lift bar illustrated in FIG. 6.

Referring next to FIG. 8, a bellcrank 360 is illustrated. The bellcrank 360 has parallel, spaced apart triangular pivot plates 362 and 364. One of the sides of the triangle is shorter than the other two in each of the pivot plates 362 and 364. A gusset plate 366 is mounted between the pivot plates 362 and 364 with one side thereof near the shortest side of the triangle to support the pivot plates 362 and 364 in their spaced-apart configuration. In the preferred embodiment, both the pivot plates 362 and 364 and the gusset plate 366 are made of steel, and are welded together.

The pivot plates 362 and 364 have apertures 370 and 372, respectively, located therein near a first corner of the triangle which will be used to mount the bellcrank 360 for pivotal movement from the apertures 104 and 106 of the pivot mount plates 100 and 102, respectively (illustrated in FIG. 1). The pivot plates 362 and 364 have apertures 374 and 376, respectively, located therein near a second corner of the triangle which will be connected via the element to be discussed in FIG. 9 below to drive the upper pin 272 of the lift bar 230 (illustrated in FIG. 6). The pivot plates 362 and 364 have apertures 378 and 380, respectively, located therein near the third corner of the triangle will be connected to a hydraulic cylinder (not shown in FIG. 9). The short side of the triangle is between the first and third corners of the triangle. The side of the gusset plate 366 adjacent this short side will act as a lift stop to limit pivotal movement of the gusset plate 366 when this side of the gusset plate 366 contacts the pivot mount plates 100 and 102 (illustrated in FIG. 1).

Figure 9:
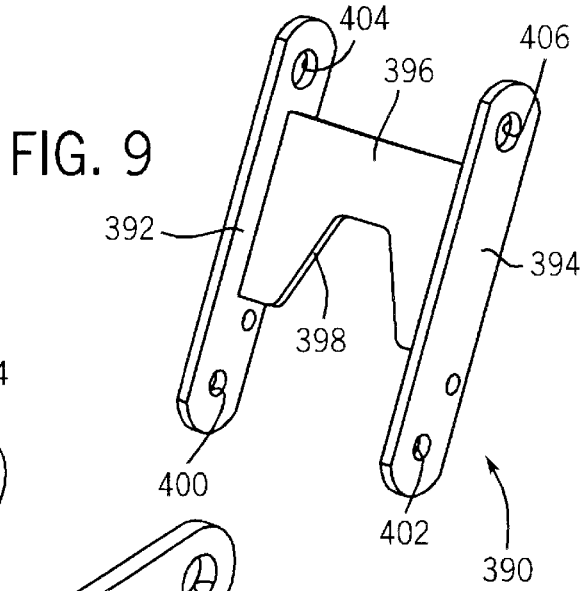
FIG. 9 is a perspective view of a lift link which connects the bellcrank illustrated in FIG. 8 to the pivoting lift bar illustrated in FIG. 6.

Referring now to FIG. 9, a lift link 390 is illustrated. The lift link 390 has parallel, spaced apart arms 392 and 394. A gusset plate 396 is mounted between the arms 392 and 394 in their spaced-apart configuration. The side of the gusset plate 396 which is oriented toward one end of the arms 392 and 394 has a notch 398 cut therein. In the preferred embodiment, both the arms 392 and 394 and the gusset plate 396 are made of steel, and are welded together. The one end of the arms 392 and 394 have apertures 400 and 402, respectively, located therein, and the other ends of arms 392 and 394 have apertures 404 and 406, respectively, located therein.

Figure 10:
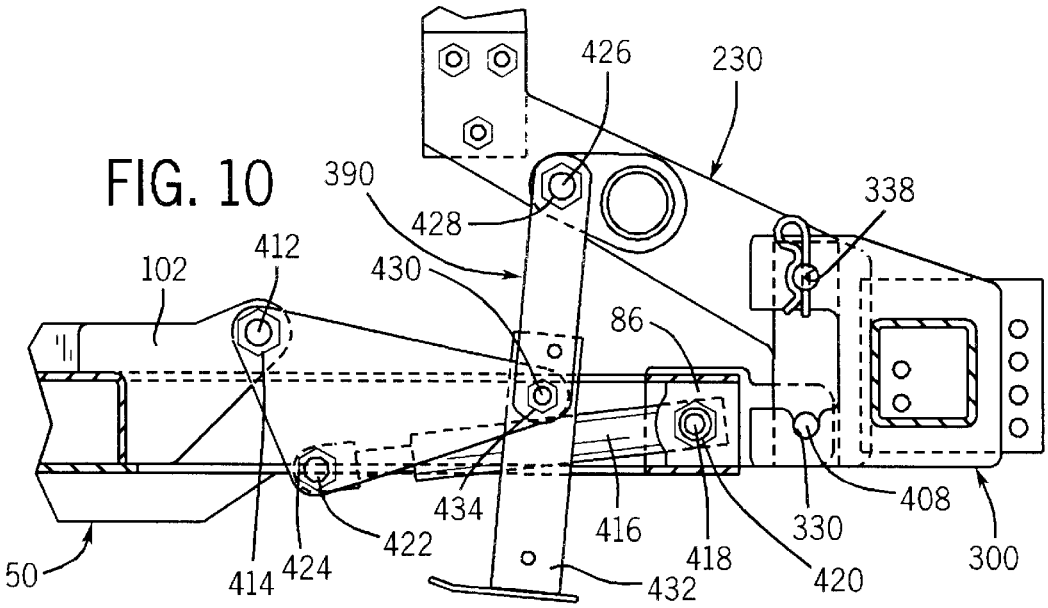
FIG. 10 is a cutaway view of the various components of the snow plow frame assembled together, showing the hydraulic cylinder used to pivot the lift bar.

Referring next to FIG. 10, the linkage used to attach the snow plow of the present invention to the hitch frame nose piece 300 is illustrated. The components which are linked together are the plow A-frame 50, the lift bar 230, the bellcrank 360, and the lift link 390. Accordingly, reference may also be had to FIGS. 1, 6, 8, and 9 as well as to FIGS. 31 and 32 in the following description of the interconnection of these components. The lift bar 230 is pivotally mounted on the plow A-frame 50 using two pins 408 and 410 (the pin 410 is not shown in FIG. 10) which are each of a length longer than distance between the opposite-facing sides of the pairs of the hitch brackets 304 and 306, or 308 and 310 (illustrated in FIG. 7). The pins 408 and 410 are preferably made of steel.

In the preferred embodiment, a hollow cylindrical collar 409 (shown in FIGS. 31 and 32) having a setscrew 411 (also shown in FIGS. 31 and 32) is used with the pin 410 as a spacer. A similar collar which a setscrew (not shown in the drawings) is used with the pin 408 as a spacer. The collar 409 will be located intermediate the lug 58 on the plow A-frame 50 and the angled stock segment 250 on the lift bar 230. The setscrew 411 on the collar 409 may be used to lock the collar 409 in place on the pin 410. The other collar will be located intermediate the lug 56 on the plow A-frame 50 and the angled stock segment 248 on the lift bar 230, with a setscrew in that collar being used to lock that collar in place on the pin 408.

The pin 408 will thus extend sequentially through the aperture 278 in the rear mounting support 236 of the lift bar 230, the aperture 60 in the lug 56 of the plow A-frame 50, the collar, and the aperture 280 in the rear mounting support 238 of the lift bar 230. The pin 408 will be retained in place by the setscrew setscrew on the collar, which will contact the pin 408 when it is screwed into the collar. Approximately equal lengths of the pin 408 extend outwardly beyond the rear mounting support 236 and the angled stock segment 248 at each end of the pin 408. Alternately, the pin 408 may be welded in place on the rear mounting support 236 and the angled stock segment 248 of the lift bar 230, or C-clips (not shown herein) could be installed in annular groves (not shown herein) in the pin 408 at locations which correspond to the ends of the collar.

The pin 410 will thus extend sequentially through the aperture 282 in the angled stock segment 250 of the lift bar 230, the collar 409, the aperture 62 in the lug 58 of the plow A-frame 50, and the aperture 284 in the rear mounting support 238 of the lift bar 230. The pin 410 will be retained in place by the setscrew 411 on the collar 409, which will contact the pin 410 when it is screwed into the collar 409. Equal lengths of the pin 410 extend outwardly beyond the angled stock segment 250 and the rear mounting support 238 at each end of the pin 410. Alternately, the pin 410 may be welded in place on the angled stock segment 250 and the rear mounting support 238 of the lift bar 230, or C-clips (not shown herein) could be installed in annular groves (not shown herein) in the pin 410 at locations which correspond to the ends of the collar 409.

It will thus be appreciated by those skilled in the art that the lift bar 230 is pivotally mounted onto the plow A-frame 50 using the pins 408 and 410. When the snow plow of the present invention is mounted onto a vehicle using the hitch frame nose piece 300, the ends of the pins 408 and 410 will be received in the pairs of slots 328 and 330, and 332 and 334 in the hitch frame nose piece 300 (illustrated in FIG. 7). Thus, the pins 408 and 410 function both to pivotally mount the lift bar 230 onto the plow A-frame 50, and to help to mount the snow plow onto the hitch frame nose piece 300.

The bellcrank 360 is pivotally mounted on the plow A-frame 50 using two bolts 412 and two nuts 414. The pivot plates 362 and 364 of the bellcrank 360 will fit outside of the pivot mount plates 100 and 102, respectively. One of the bolts 412 will extend through the aperture 104 in the pivot mount plate 100 of the plow A-frame 50 and the aperture 370 in the pivot plate 362 of the bellcrank 360, and one of the nuts 414 will be mounted on that bolt 412 to retain it in place. The other one of the bolts 412 will extend through the aperture 106 in the pivot mount plate 102 of the plow A-frame 50 and the aperture 372 in the pivot plate 364 of the bellcrank 360, and the other one of the nuts 414 will be mounted on that bolt 412 to retain it in place.

The bolts 412 allow the bellcrank 360 to pivot on the plow A-frame 50. In the preferred embodiment, a spacer and two washers (not shown) may be used with each of the bolts 412, the spacer going through the apertures in the parts being pivotally joined and being longer than the combined thickness of the apertures in the parts, and a washer being located on either end of the spacer to facilitate free rotation of parts, here movement of the bellcrank 360 with reference to the plow A-frame 50. It will be understood by those skilled in the art that a spacer and two washers will preferably be used at other points of relative movement between two elements of linkage of the snow plow described herein, although the spacer and two washers will not be specifically mentioned in conjunction with each of these pivoting connections made between two elements using a bolt. In addition, it will be understood by those skilled in the art that a pin retained by a cotter pin (not shown herein) could be used instead of a bolt and nut in many of the applications for a fastener used in the linkage discussed herein.

A hydraulic cylinder 416 is mounted at one end to the cylinder mounts 84 and 86 of the plow A-frame 50 using a bolt 418 which extends through the aperture 96 in the cylinder mount 84 and the aperture 98 in the cylinder mount 86, with a nut 420 being used to retain the bolt 418 in place. The other end of the hydraulic cylinder 416 drives the third corner of the triangular pivot plates 362 and 364 of the bellcrank 360, with a bolt 422 extending between the aperture 378 in the pivot plate 362 of the bellcrank 360 and the aperture 380 in the pivot plate 364 of the bellcrank 360. A nut 424 is used to retain the bolt 422 in place. The bolts 418 and 422 allow the hydraulic cylinder 416 to move as it drives the bellcrank 360. Spacers (not shown herein) may be used on each side of the other end of the hydraulic cylinder 416 on the insides of the pivot plates 362 and 364 to center the hydraulic cylinder 416.

The lift link 390 is used to connect the bellcrank 360 to pivot the lift bar 230. A bolt 426 is used to connect the lift link 390 to the lift bar 230, with the bolt 426 extending sequentially through the aperture 404 in the arm 392 of the lift link 390, the upper pin 272 from the end extending through the upper pin hanger plate 264 to the end extending through the upper pin hanger plate 266 of the lift bar 230, and the aperture 406 in the arm 394 of the lift link 390. A nut 428 is used to retain the bolt 426 in place. The bolt 426 allows the lift link 390 to pivot on the lift bar 230, and a spacer and two washers may also be used as mentioned hereinabove.

The second corner of the triangle formed by the pivot plates 362 and 364 of the bellcrank 360 drives the ends of the arms 392 and 394 of the lift link 390 which are not connected to the lift bar 230. Two bolts 430 are used to connect the bellcrank 360 to the lift link 390, with one of the bolts 430 also being used to mount a stand 432. The stand 432 is described in U.S. Pat. No. 5,894,688, to Struck et al., which patent is assigned to the assignee of the inventions described herein. U.S. Pat. No. 5,894,688 is hereby incorporated herein by reference.

One bolt 430 (not shown) extends through the aperture 400 in the arm 392 of the lift link 390 and the aperture 374 of the pivot plate 362 of the bellcrank 360, with a nut 434 being used to retain the first bolt 430 in place, and a spacer and two washers may also be used as mentioned hereinabove. The other bolt 430 extends sequentially through an aperture (not shown) in the upper portion of the stand 432, the aperture 376 of the pivot plate 364 of the bellcrank 360, and the aperture 402 in the arm 394 of the lift link 390, with a nut 434 being used to retain the second bolt 430 in place. The second bolt 430 allows the lift link 390 to pivot on the bellcrank 360, and a spacer and two washers may again be used as mentioned hereinabove. A removable pin (not shown) extending through an aperture near the top of the stand 432 and apertures located in the lift link 390 is used to link the stand 432 with the lift link 390.

The hydraulic cylinder 416 is shown in FIG. 10 nearly in its fully retracted position. When the hydraulic cylinder 416 is fully extended, it will be appreciated by those skilled in the art that the lift bar 230 will rotate counterclockwise from the position in which it is shown in FIG. 10, and the stand 432 will be lowered to engage the ground (not shown) and thereby tend to lift the rear end of the plow A-frame 50 upwardly. It will also be appreciated that once the pins 408 and 410 are in engagement with the slots 328, 330, 332, and 334 in the hitch brackets 304, 306, 308, and 310, respectively, of the hitch frame nose piece 300, the hydraulic cylinder 416 may be used to align the apertures 286, 288, 290, and 292 on the lift bar 230 with the apertures 336, 338, 340, and 342, respectively, in the hitch brackets 304, 306, 308, and 310, respectively, of the hitch frame nose piece 300.

Turning next to FIGS. 11 through 16, a plow blade 440 and various aspects thereof are illustrated. The plow blade 440 has a frame which may be fundamentally thought of as a horizontal top plow frame member 442, a bottom plow frame member 444, and a plurality of vertical ribs 446, 448, 450 452, 454, 456, and 458 extending between the top plow frame member 442 and the bottom plow frame member 444. The top plow frame member 442 is made of a triangular tube as best shown in FIG. 13. The bottom plow frame member 444 is made of a three sided channel resembling a wide, inverted "U" with the tops of the legs of the "U" angling outwardly as best shown in FIG. 14.

The right side rib 446 is located on the right side of the plow blade 440, and the left side rib 458 is located on the left side of the plow blade 440. The ribs 448, 450, 452, 454, and 456 are located at evenly spaced intervals intermediate the right side rib 446 and the left side rib 458. Note that all of the ribs 446, 448, 450 452, 454, 456, and 458 have an arcuate shape when viewed from the side. The ribs 448, 450, 452, 454, and 456 all extend between the back side of the top plow frame member 442 and the top side of the bottom plow frame member 444, while the right side rib 446 and the left side rib 458 are mounted on the ends of the top plow frame member 442 and the bottom plow frame member 444, thereby overlying them as best shown in FIGS. 11 through 14. The top plow frame member 442, the bottom plow frame member 444, and the ribs 446, 448, 450 452, 454, 456, and 458 are all preferably made of steel, and are welded together.

Located in front of the ribs 450 and 454 are curved reinforcing plates 460 and 462 which serve to strengthen the ribs 450 and 454, which will be used to mount the plow blade 440 to the swing frame 140 (shown in FIGS. 3 through 5). The rib 450 has a mounting aperture 464 which extends therethrough and which is located near to the bottom end of the rib 450. Similarly, the rib 454 has a mounting aperture 466 which extends therethrough and which is located near to the bottom end of the rib 454. The curved reinforcing plates 460 and 462 are welded to the ribs 450 and 454, respectively, and to the top plow frame member 442 and the bottom plow frame member 444.

Four arcuate torsional stiffeners 468, 470, 472, and 474 are used to provide stiffness to the configuration of the plow blade 440. The torsional stiffener 468 extends from the bottom of the rib 448 to a position near the top of the right side rib 446. The torsional stiffener 470 extends from the bottom of the rib 450 to a position near the top of the rib 448. The torsional stiffener 472 extends from the bottom of the rib 454 to a position near the top of the rib 456. The torsional stiffener 474 extends from the bottom of the rib 456 to a position near the top of the left side rib 458. The torsional stiffeners 468, 470, 472, and 474 are also preferably made of steel, and are welded to other components in the plow blade 440.

Located on the left side of the right side rib 446 and on the right side of the left side rib 458 are curved support plates 476 and 478, respectively. The curved support plates 476 and 478 are recessed back from the front edges of the right side rib 446 and the left side rib 458, respectively, as best shown in FIG. 15 for the curved support plate 478. The curved support plates 476 and 478 are preferably also made of steel, and are welded to other components in the plow blade 440. The frontmost portions of the top plow frame member 442, the curved support plate 476, the rib 448, the curved reinforcing plate 460, the rib 452, the curved reinforcing plate 462, the rib 456, and the curved support plate 478 together define a curved support surface which will support a moldboard 480 thereupon. The right side rib 446 and the left side rib 458 extend slightly forward of the top plow frame member 442, the bottom plow frame member 444, and the ribs 448, 450, 452, 454, and 456, to thereby prevent the moldboard 480 from moving laterally. The moldboard 480 may be made of a man-made material such as polycarbonate, which may be clear, or other man-made materials such as ultra-high molecular weight (UHMW) polyethylene, or steel.

Extending across the front side of the top plow frame member 442 is a moldboard retainer strip 482 (best shown in FIG. 13), into which the top edge of the moldboard 480 fits and is retained. The moldboard retainer strip 482 is bent slightly toward the top plow frame member 442, which ensures that the top edge of the moldboard 480 fits snugly therein. Thus, it will be appreciated that the top, right, and left sides of the moldboard 480 are retained in position on the plow blade 440. The front of the bottom plow frame member 444 extends forwardly with respect to the curved moldboard support surface defined by the frontmost portions of the top plow frame member 442, the curved support plate 476, the rib 448, the curved reinforcing plate 460, the rib 452, the curved reinforcing plate 462, the rib 456, and the curved support plate 478. The bottom edge of the moldboard 480 comes just to the top of the bottom plow frame member 444, as best shown in FIG. 14.

The front of the bottom plow frame member 444 has a plurality of tapped apertures 484 located therein across the entire width thereof. A wearstrip 486 which is approximately the same width as the bottom plow frame member 444 has a matching plurality of apertures 488 located therein. The wearstrip 486 is preferably made of a high carbon steel such as AISI 1080 high carbon steel. The wearstrip 486 is bolted onto the bottom plow frame member 444 with a plurality of bolts 490. Alternately, if the apertures 484 are not tapped, bolts and nuts could be used to mount the wearstrip 486 onto the bottom plow frame member 444. optionally, the apertures 488 in the wearstrip 486 may be countersunk to recess the heads of the bolts 490 to the level of surface of the wearstrip 486. The front of the bottom plow frame member 444 is arranged and configured such that the wearstrip 486 will be mounted with its bottom edge angled forwardly with respect to the ground at angle of between approximately zero and forty-five degrees, with between approximately fifteen and thirty degrees being preferred, and an angle of approximately twenty-five degrees being most preferred.

The wearstrip 486 retains the bottom of the moldboard 480 in place, and it will at once be appreciated that the moldboard 480 may be replaced by merely removing the wearstrip 486, making the replacement substantially easier than in earlier snow plow blade designs. When the wearstrip 486 is bolted to the bottom plow frame member 444, it will be appreciated by those skilled in the art that it extends well below the bottom of the bottom plow frame member 444, so that as it is worn down, the bottom plow frame member 444 will not be damaged by contact with the ground.

Mounted on the back of the ribs 450 and 454, respectively, are two trip spring brackets 492 and 494. The trip spring brackets 492 and 494 are mounted approximately three-quarters of the way up the ribs 450 and 454, and are bent at a ninety degree angle, the bends being on an axis parallel to the lateral axis of the plow blade 440. The portions of the trip spring brackets 492 and 494 facing forward have notches 496 and 498, respectively, cut into them from the forward-most edges thereof to the bends therein. The rear edges of the ribs 450 and 454 fit into the notches 496 and 498, respectively, and the portions of the spring brackets 492 and 494 facing rearwardly fit against the ribs 450 and 454, respectively. The spring brackets 492 and 494 are also preferably made of steel, and are welded onto the ribs 450 and 454, respectively. The rear-facing portion of the trip spring bracket 492 has two apertures 500 and 502 located therein on which lie on opposite sides of the rib 450, and the rear-facing portion of the trip spring bracket 494 has two apertures 504 and 506 located therein on which lie on opposite sides of the rib 454.

Located on the right side of the plow blade 440 in the right side rib 446 near the top thereof are two apertures 512. Similarly, located on the left side of the plow blade 440 in the left side rib 458 near the top thereof are two apertures 514. The apertures 512 and 514 serve to allow a marker bar or the like (not shown in FIGS. 11 through 13) to be attached to the plow blade 440.

Located at the rear of the plow blade 440 at the bottom thereof is a back blade wearstrip 516, which is mounted onto the bottom plow frame member 444 and extends substantially across the width of the plow blade 440. The back blade wearstrip 516 has a plurality of apertures 518 therein, and the bottom plow frame member 444 has matching tapped apertures 520 located in the rear-facing side thereof. Bolts 522 are used in the back blade wearstrip 516 to mount it onto the bottom plow frame member 444. Alternately, if the apertures 520 are not tapped, bolts and nuts could be used to mount the back blade wearstrip 516 onto the bottom plow frame member 444. Optionally, the apertures 518 in the back blade wearstrip 516 may be countersunk to recess the heads of the bolts 522 to the level of surface of the back blade wearstrip 516.

The back blade wearstrip 516 is permanently mounted at an optimum angle with respect to the ground which is defined by the angle of the rear side of the bottom plow frame member 444. The rear of the bottom plow frame member 444 is arranged and configured such that the back blade wearstrip 516 will be mounted with its bottom edge angled rearwardly with respect to the ground at angle of between approximately zero and forty-five degrees, with between approximately fifteen and thirty degrees being preferred, and an angle of approximately twenty-five degrees being most preferred. In the preferred embodiment, the wearstrip 486 and the back blade wearstrip 516 will be mounted at the same angles, but with the wearstrip 486 being angled forwardly and the back blade wearstrip 516 being angled rearwardly.

In the preferred embodiment, the back blade wearstrip 516 is made of an UHMW polyethylene material which is used instead of steel to decrease the weight of the plow blade 440. Alternately, the back blade wearstrip 516 could be made of rubber, urethane, steel, aluminum, or any other suitable material. Also, if desired, the back blade wearstrip 516 can be manufactured as multiple identical narrower segments if desired.

Figure 18:
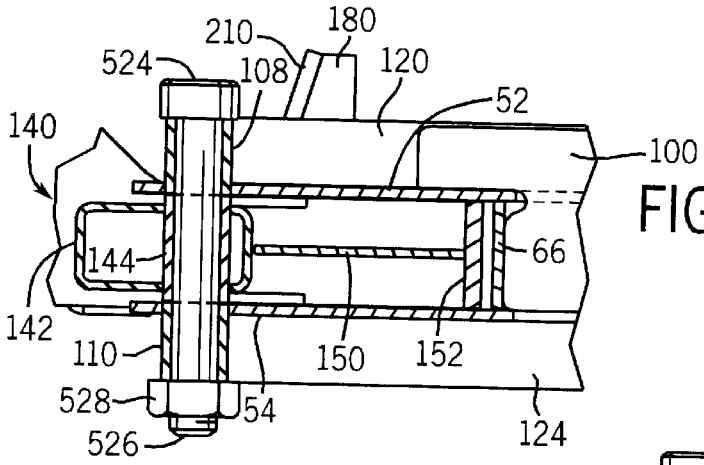
FIG. 18 is a partial cross-sectional view showing the plow swing frame and the plow A-frame illustrated in FIG. 17 assembled together.
Figure 17:
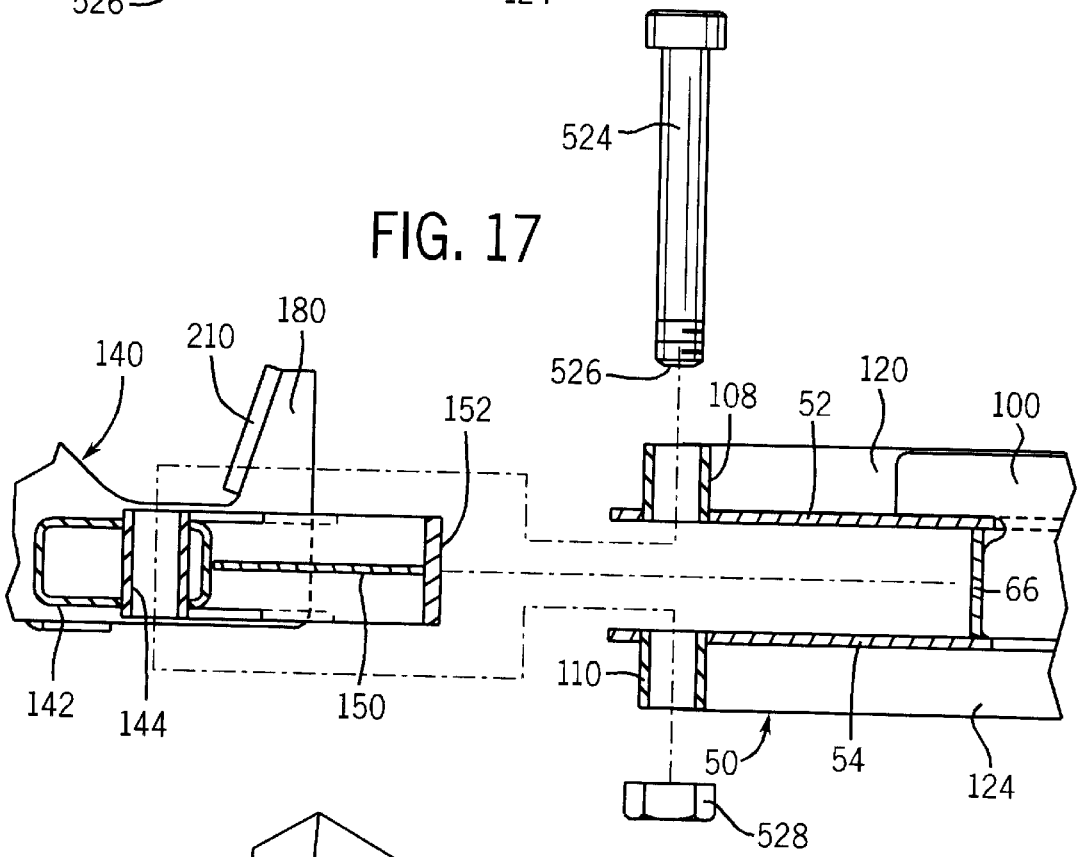
FIG. 17 is an exploded, partial cross-sectional view showing the assembly of the plow swing frame illustrated in FIGS. 3 through 5 onto the plow A-frame illustrated in FIGS. 1 and 2.

Turning next to FIGS. 17 and 18, and making reference also to FIGS. 1 and 3 through 5, the installation of the swing frame 140 onto the plow A-frame 50 is illustrated. The rectangular swing frame tube 142 of the swing frame 140 is inserted between the top plate 52 and the bottom plate 54 of the plow A-frame 50, with the pivot 144 of the swing frame 140 being brought into alignment intermediate the swing frame pivot 108 and the swing frame pivot 110 of the plow A-frame 50. A pivot pin 524 having a threaded distal end 526 is inserted sequentially through the swing frame pivot 108 in the plow A-frame 50, the pivot 144 in the swing frame 140, and the swing frame pivot 110 in the plow A-frame 50, and is retained in place by a locking nut 528. Washers (not shown herein) may also be used if desired.

Thus, the swing frame 140 is pivotally mounted on the plow A-frame 50, and it will be appreciated by those skilled in the art that the movement of the swing frame 140 is limited by the guide/stop bar 152 on the swing frame 140 which interacts with the rectangular plate 66 on the plow A-frame 50 to limit movement to approximately thirty degrees either to the right or to the left. The swing frame 140 will be pivoted by two hydraulic cylinders, the installation of which will be described later in conjunction with FIG. 30.

It will be appreciated by those skilled in the art that the design of the plow A-frame 50 and the swing frame 140 represents a substantial improvement over past snow plow frame designs since their centerlines are in the same horizontal plane. Thus, rather than having the swing frame 140 being located on top of the plow A-frame 50, the swing frame 140 is located in the same plane as is the plow A-frame 50. In the preferred embodiment, the apertures 60 and 62 in the lugs 56 and 58, respectively, as well as the pins 408 and 410, are also in the same horizontal plane.

Figure 19:
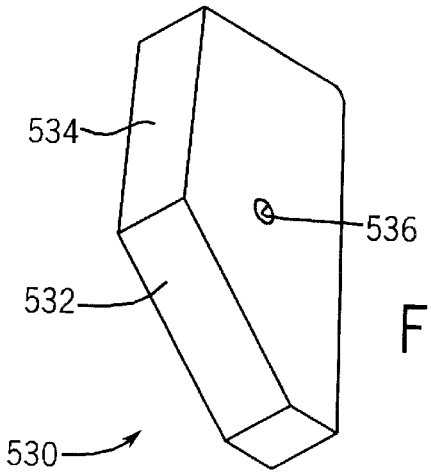
FIG. 19 is a perspective view of a blade stop cushion.

Moving now to FIG. 19, a cushion block 530 is illustrated which will be used to absorb the impact of the plow blade 440 (shown in FIG. 11) as it moves between its limits. Such movement of the plow blade 440 is caused by the plow blade 440 striking an object, and is designed to prevent damage to the snow plow by allowing the plow blade 440 to "trip," that is, for the bottom of the plow blade 440 to move rearwardly and the top of the plow blade 440 to simultaneously move forward, resulting in a rotation of the plow blade 440 around a horizontal axis. Such a rotation is inhibited by springs, which act as a shock absorbing mechanism, and which return the plow blade 440 to a normal or "trip return" position. The springs are quite strong, since they must prevent the plow blade 440 from rotating when it is plowing snow, and the metal-to-metal impacts of both a blade trip and a blade trip return can be substantial. The cushion block 530 is designed to cushion the impacts on both the blade trip and the blade trip return.

The cushion block 530 is brick-shaped with a corner cut off to create a beveled face 532, and will be mounted with the beveled face 532 of the cushion block 530 facing both forwardly and downwardly. Above the beveled face 532 of the cushion block 530 and facing forwardly when the cushion block 530 is mounted is a front face 534. Extending laterally through the cushion block 530 at a central location is an aperture 536, which will be used to mount the cushion block 530 on the swing frame 140 (shown in FIGS. 3 through 5). A cushion block 530 will be mounted between each pair of the blade pivot mounts 178 and 180, and 182 and 184. The apertures 202 and 204 in the blade pivot mounts 178 and 180, respectively, will align with the aperture 536 in one cushion block 530, and the apertures 206 and 208 in the blade pivot mounts 182 and 184, respectively, will align with the aperture 536 in the other cushion block 530.

Figure 11:
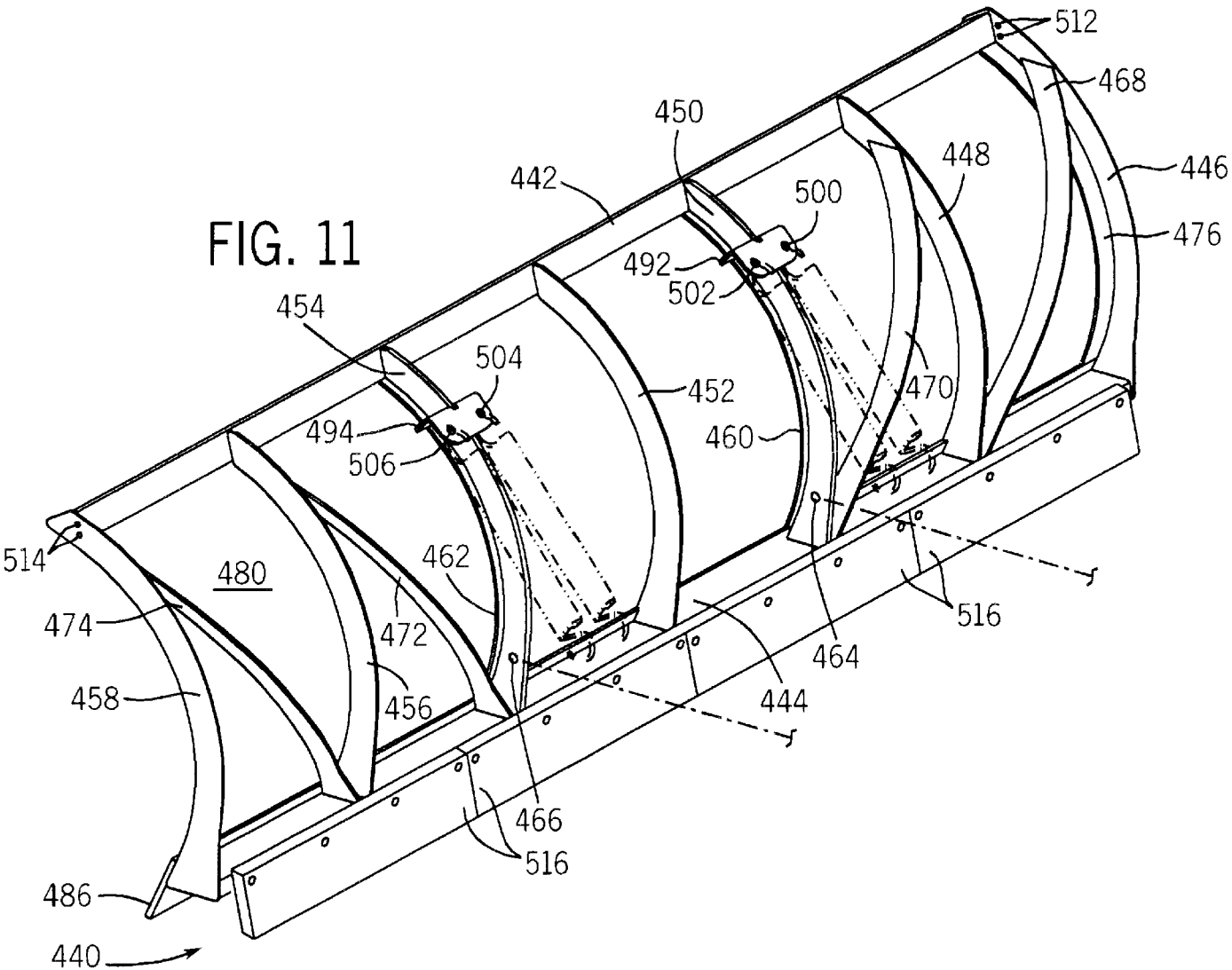
FIG. 11 is a perspective view of a plow blade from the rear side which will be mounted onto the plow swing frame illustrated in FIGS. 3 through 5.
Figure 20:
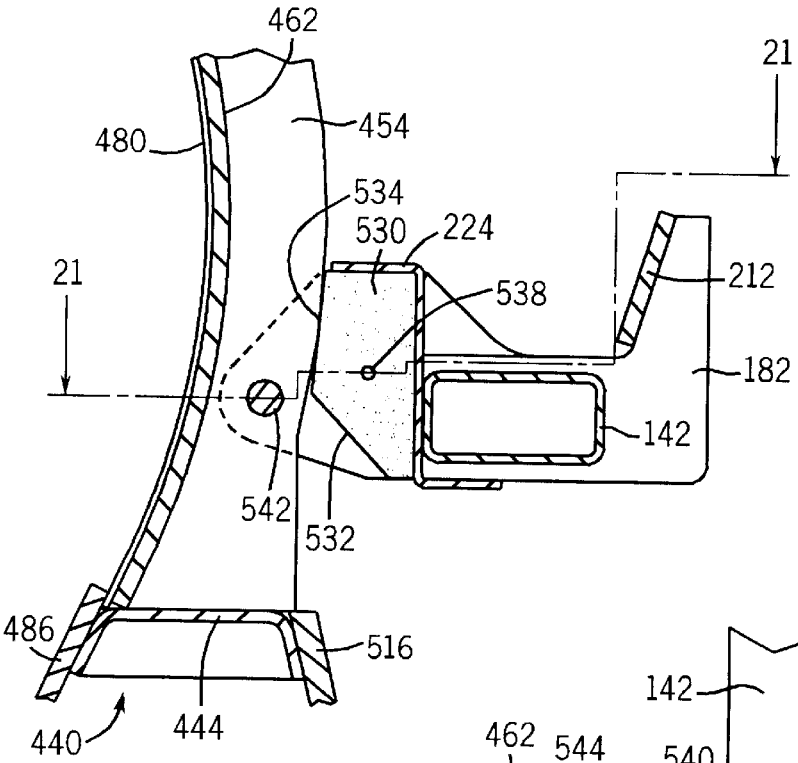
FIG. 20 is a cross-sectional view from the side showing the installation of the blade stop cushion illustrated in FIG. 19 onto the plow swing frame, with the plow blade in its normal position as stopped by the blade stop cushion.
Figure 21:
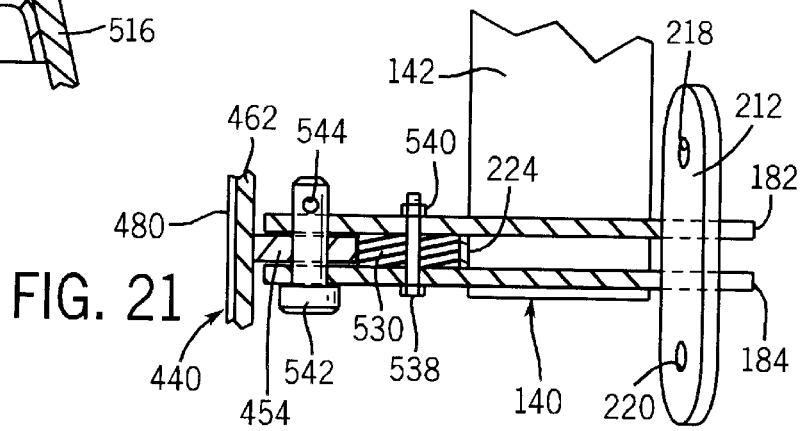
FIG. 21 is a cross-sectional view of the components illustrated in FIG. 20, from the top side thereof.
Figure 22:
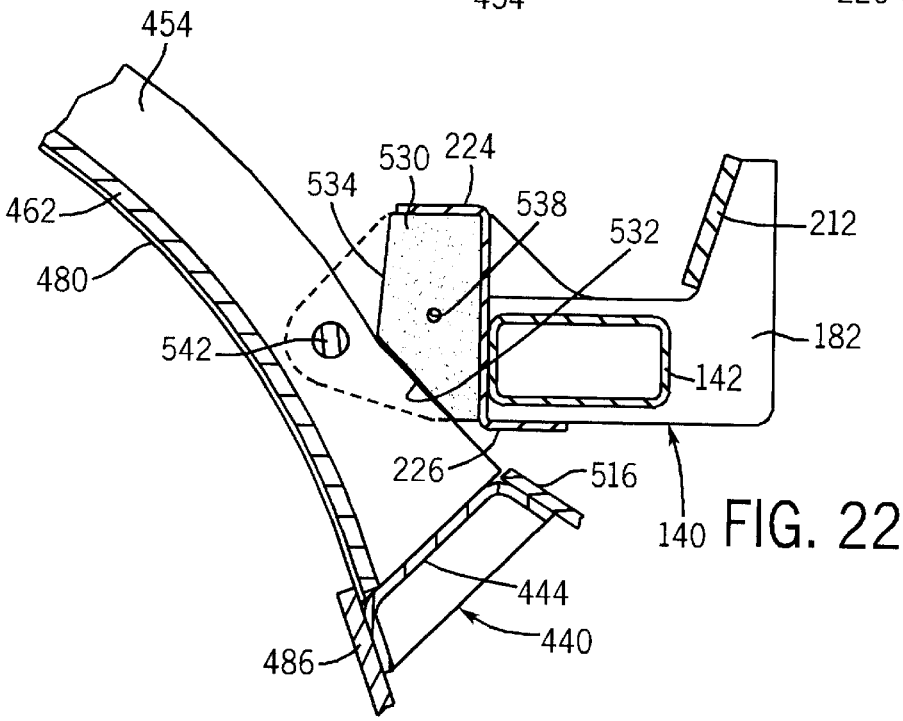
FIG. 22 is a cross-sectional view from the side similar to the view of FIG. 20, but with the plow blade in a rotated position as stopped by the blade stop cushion.

Turning next to FIGS. 20 through 22, and referring also to FIGS. 3, 11, and 19, the installation of both the cushion blocks 530 and the plow blade 440 onto the swing frame 140 is illustrated. One of the cushion blocks 530 is shown installed between the blade pivot mounts 182 and 184, with a bolt 538 extending sequentially through the aperture 208 in the blade pivot mount 184, the aperture 536 in the cushion block 530, and the aperture 206 in the blade pivot mount 182, and with a nut 540 being used to retain the bolt 538 in place. The top and the rearwardly facing side of the cushion block 530 are retained in position by the stop 222 in the swing frame 140. The other cushion block 530 would be similarly mounted between the blade pivot mounts 178 and 180. Alternately, silicone adhesive (or any other suitable type of adhesive) may be used instead of bolts to retain the cushion blocks 530 in place. Another alternate retaining mechanism would be to have the cushion blocks 530 fit in place with an interference fit.

The plow blade 440 will pivot around an axis defined by the mounting apertures 464 and 466 located in the ribs 450 and 454, respectively, and is mounted onto the swing frame 140 using two pins 542. One of the pins 542 extends sequentially through the aperture 200 in the blade pivot mount 184, the mounting aperture 466 in the rib 454, and the aperture 198 in the blade pivot mount 182. The other one of the pins 542 extends sequentially through the aperture 196 in the blade pivot mount 180, the mounting aperture 464 in the rib 450, and the aperture 194 in the blade pivot mount 180. Retaining pins 544 are installed into diametrically extending apertures located in the distal ends of each of the pins 542, and retain the pins 542 in place, thereby pivotally mounting the plow blade 440 on the swing frame 140.

The plow blade 440 thus may pivot between the trip return position shown in FIG. 20 and the tripped position shown in FIG. 22. It will be appreciated by those skilled in the art that when the plow blade 440 hits an object on the ground sufficiently hard, it will be driven to the tripped position shown in FIG. 22, at which time the portion of the rib 454 and also the portion of the rib 450 (which is not shown in FIG. 22) below the pins 542 will contact the beveled faces 532 of the cushion blocks 530, which will absorb the impact. Similarly, when the plow blade 440 is driven back into the trip return position shown in FIG. 20, the portion of the rib 454 and also the portion of the rib 450 (which is not shown in FIG. 22) above the pins 542 will contact the front face 534 of the cushion blocks 530, which will absorb the impact. In the preferred embodiment, the cushion blocks 530 are made of polyurethane, such as, for example, Quazi formulated methylenebisdiphenyl diisocyanate (MDI) polyester-based 93 durometer (Shore A scale) polyurethane, available commercially from Kryptonics, Inc. under the trademark Kaptane 93 black.

Figure 24:
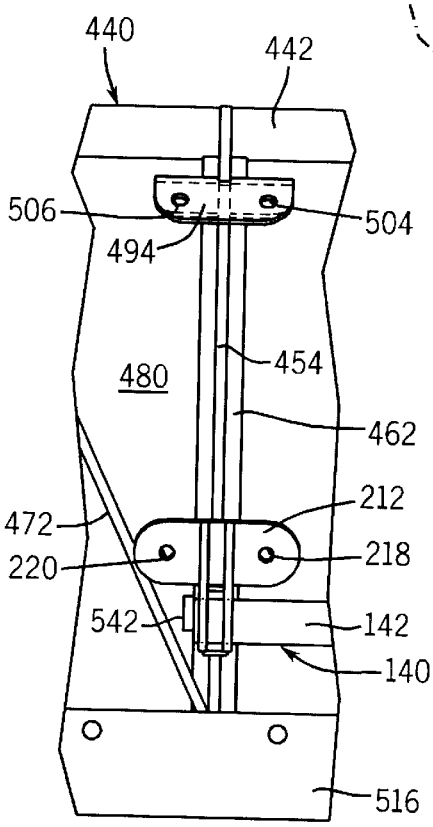
FIG. 24 is a partial rear plan view of the plow blade, the plow swing frame, and the spring mounts illustrated in FIG. 23.
Figure 23:
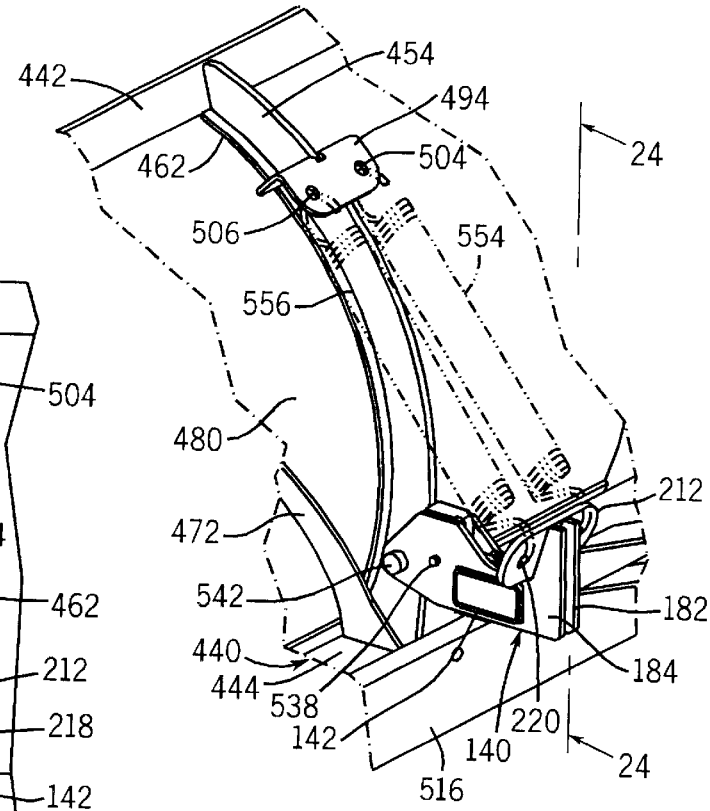
FIG. 23 is a perspective view of portions of the plow blade and the plow swing frame, showing the spring mounts on one side of the plow blade and the plow swing frame, and also showing two springs in phantom lines.
Figure 16:
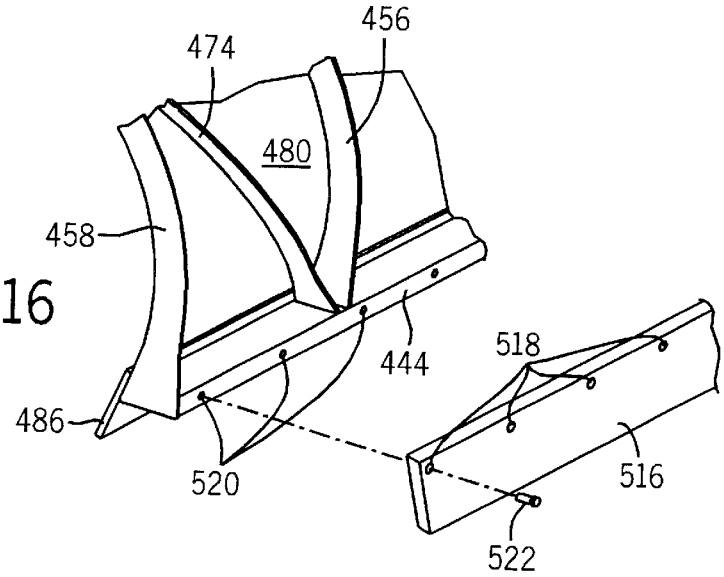
FIG. 16 is a partial perspective view of the rear of the plow blade illustrated in FIG. 11, showing the installation of a wear strip onto the rear of the plow blade.

Referring now to FIGS. 23 and 24, portions of the left side of the swing frame 140 and the plow blade 440 are illustrated in the blade trip return position. In the principal design described herein and shown in the drawings, four trip springs 550, 552, 554, and 556 (the first two of which are not shown in FIG. 23 or 24) will be used to bias the plow blade 440 into the trip return position, and to resist movement of the plow blade 440 into the tripped position. Two trip springs 550 and 552, or 554 and 556 will be located on each side of the swing frame 140 and the plow blade 440. The trip springs 554 and 556 are shown in phantom lines in FIG. 23, with the trip spring 554 being connected between the aperture 218 of the trip spring bracket 212 and the aperture 504 of the trip spring bracket 494, and the trip spring 556 being connected between the aperture 220 of the trip spring bracket 212 and the aperture 506 of the trip spring bracket 494.

It will at once be appreciated by those skilled in the art that the trip springs 554 and 556 are located immediately on either side of the pivoting connection between the plow blade 440 and the swing frame 140. The trip springs 554 and 556 exert a force in a plane which is parallel to the plane of rotation defined by the pivoting connection between the plow blade 440 and the swing frame 140. Thus, the trip springs 554 and 556 do not pull in a direction which is even in part at an angle to the plane of rotation. This represents a major advantage over previously known snow plow trip spring mounting designs, which without exception are located at an angle to the plane of rotation defined by the pivoting connection between the plow blade and the swing frame of such previously known snow plows. The design of the snow plow described herein utilizes all of the trip spring force for the blade trip operation, and thus provides more consistent blade trip operation as well as eliminating lateral trip spring force being exerted on the frame of the plow blade 440.

Turning next to FIGS. 25 and 26, an alternate embodiment is illustrated in which two trip springs are used to bias the plow blade 440 into the trip return position, and to resist movement of the plow blade 440 into the tripped position. One trip spring will be located on each side of the swing frame 140 and the plow blade 440 (the trip spring 560 on the left side of the swing frame 140 and the plow blade 440 is illustrated in the blade trip return position in FIG. 25). In the alternate embodiment illustrated in FIGS. 25 and 26, the design of the trip spring brackets which are mounted on the back of the ribs 450 and 454 differs from the design of the trip spring brackets 210 and 212 (shown in FIGS. 3 through 5). A trip spring bracket 562 having a single aperture 564 located therein is mounted on the blade pivot mounts 182 and 184. The trip spring bracket 562 is also preferably made of steel, and is welded onto the blade pivot mounts 182 and 184 with the aperture 564 being located between the blade pivot mounts 182 and 184. An identical spring trip bracket (not shown) would also be used on the right side of the swing frame 140.

Figure 12:
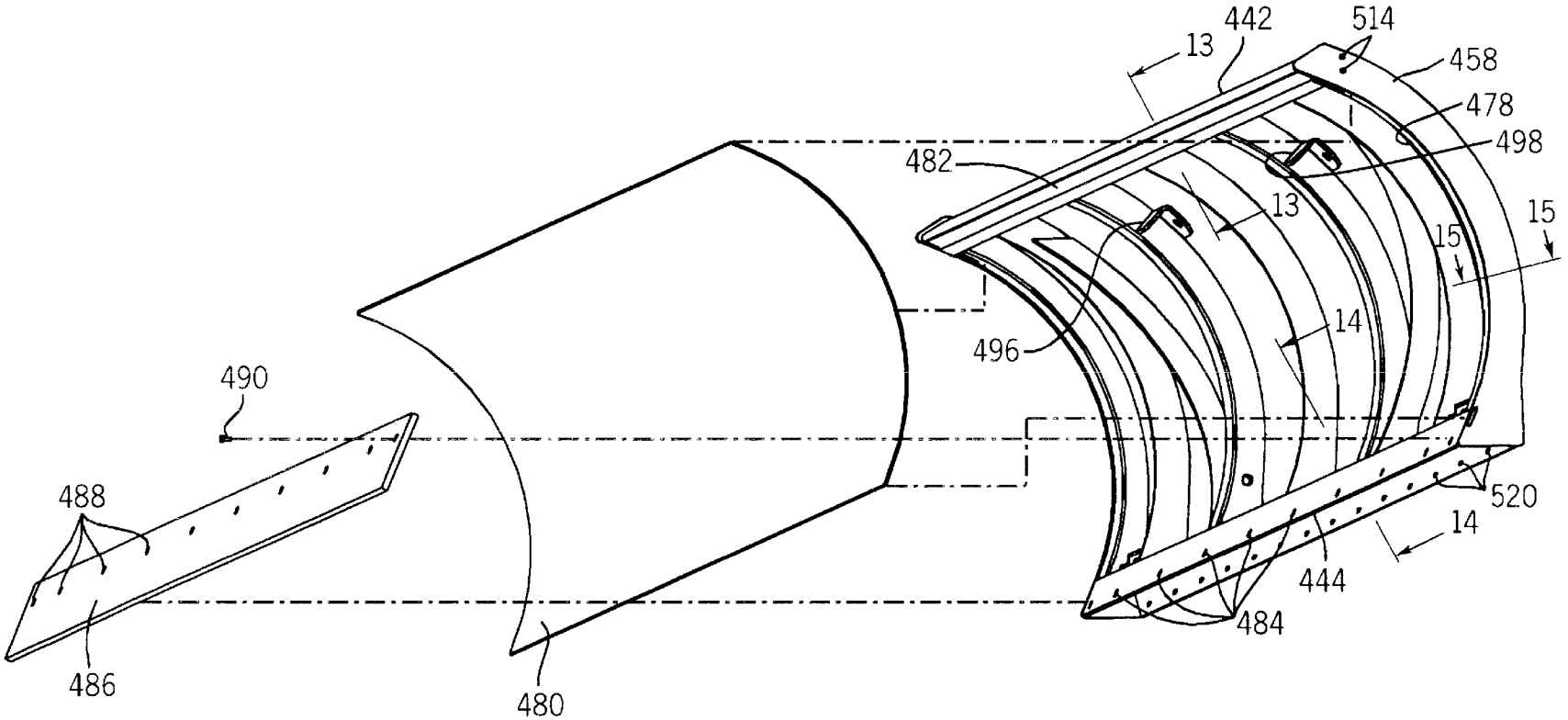
FIG. 12 is an exploded view of the plow blade illustrated in FIG. 11, showing the assembly of a moldboard made of man-made material onto the plow blade frame.

In the alternate embodiment illustrated in FIGS. 25 and 26, the design of the trip spring brackets which are mounted on the back of the ribs 450 and 454 also differs from the design of the trip spring brackets 492 and 494 (shown in FIGS. 11 and 12). A trip spring bracket 566 is mounted approximately three-quarters of the way up the rib 454, and is bent at a ninety degree angle, the bend being on an axis parallel to the lateral axis of the plow blade 440. The portion of the trip spring bracket 566 facing forward has a notch 568 cut into it from the forwardmost edge thereof to the bend therein. The rear edge of the rib 454 fits into the notch 568, and the portion of the spring bracket 566 facing rearwardly fits against the rib 454. The rear-facing portion of the trip spring bracket 566 has an aperture 570 located therein which lies in the same plane as the rib 454. The spring bracket 566 is also preferably made of steel, and is welded onto the rib 454. An identical spring trip bracket (not shown) would also be used on the right side of the plow blade 440.

It will be appreciated by those skilled in the art that the trip spring 560 is located, and exerts a force, in the plane of rotation defined by the pivoting connection between the plow blade 440 and the swing frame 140. Thus, the trip spring 560 does not pull in a direction which is even in part at an angle to the plane of rotation (unlike previously known snow plow trip spring mounting designs). The alternate embodiment design of the snow plow of FIGS. 25 and 26 utilizes all of the trip spring force for the blade trip operation and provides more consistent blade trip operation as well as eliminating lateral trip spring force being exerted on the frame of the plow blade 440.

Figure 27:
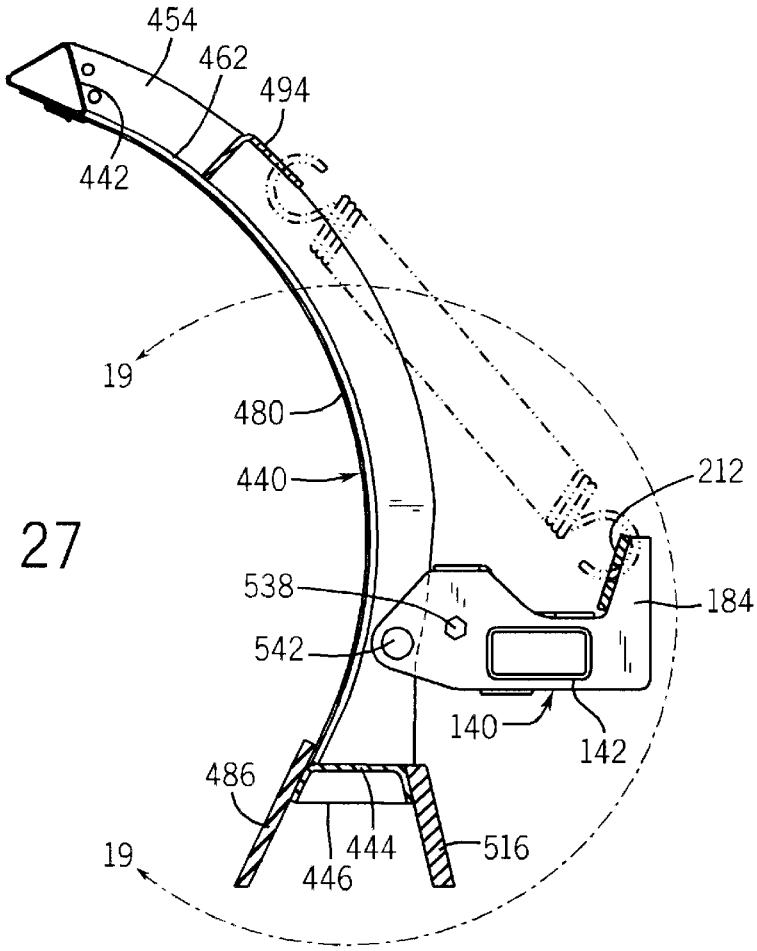
FIG. 27 is a cross-sectional view from the side of the assembled plow blade and the plow swing frame, showing the plow blade in its normal position.
Figure 28:
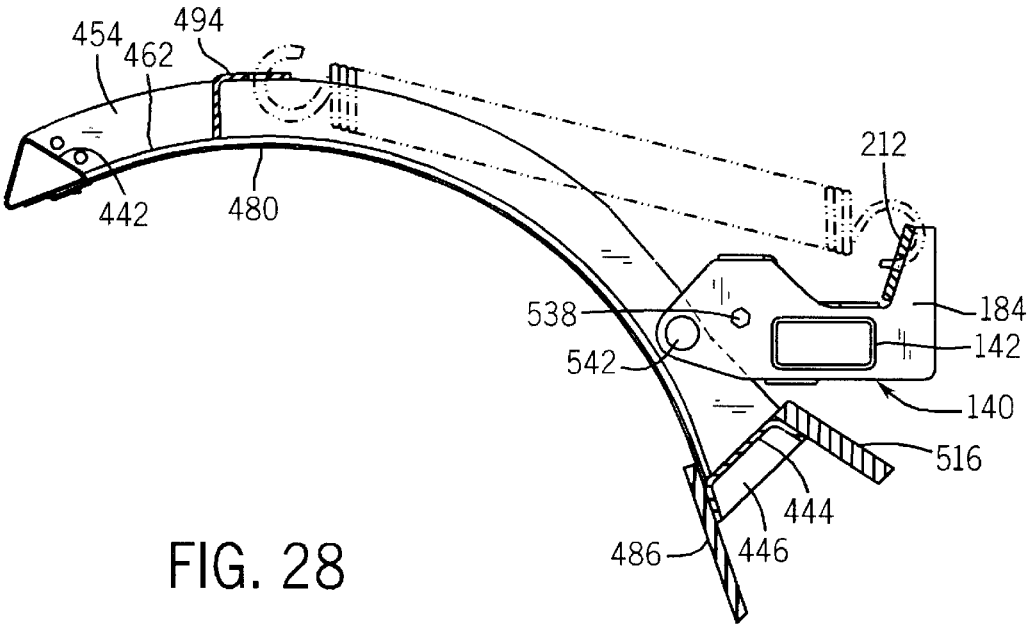
FIG. 28 is a cross-sectional view from the side of the assembled plow blade and the plow swing frame, showing the plow blade in its rotated position.

Referring next to FIGS. 27 and 28, the movement of the plow blade 440 between the trip return position shown in FIG. 27 and the fully tripped position shown in FIG. 28 is illustrated. From these figures (and also by looking at the orientation of the trip springs 550, 552, 554, and 556 in the top plan view of FIG. 30), it will be appreciated that the trip springs 550, 552, 554, and 556 (which are already under tension even in the trip return position) are all further stretched as the plow blade 440 moves from the trip return position to the tripped position, and thus serve to return the plow blade 440 to the trip return position when the force which caused the plow blade 440 to be tripped is removed.

Figure 29:
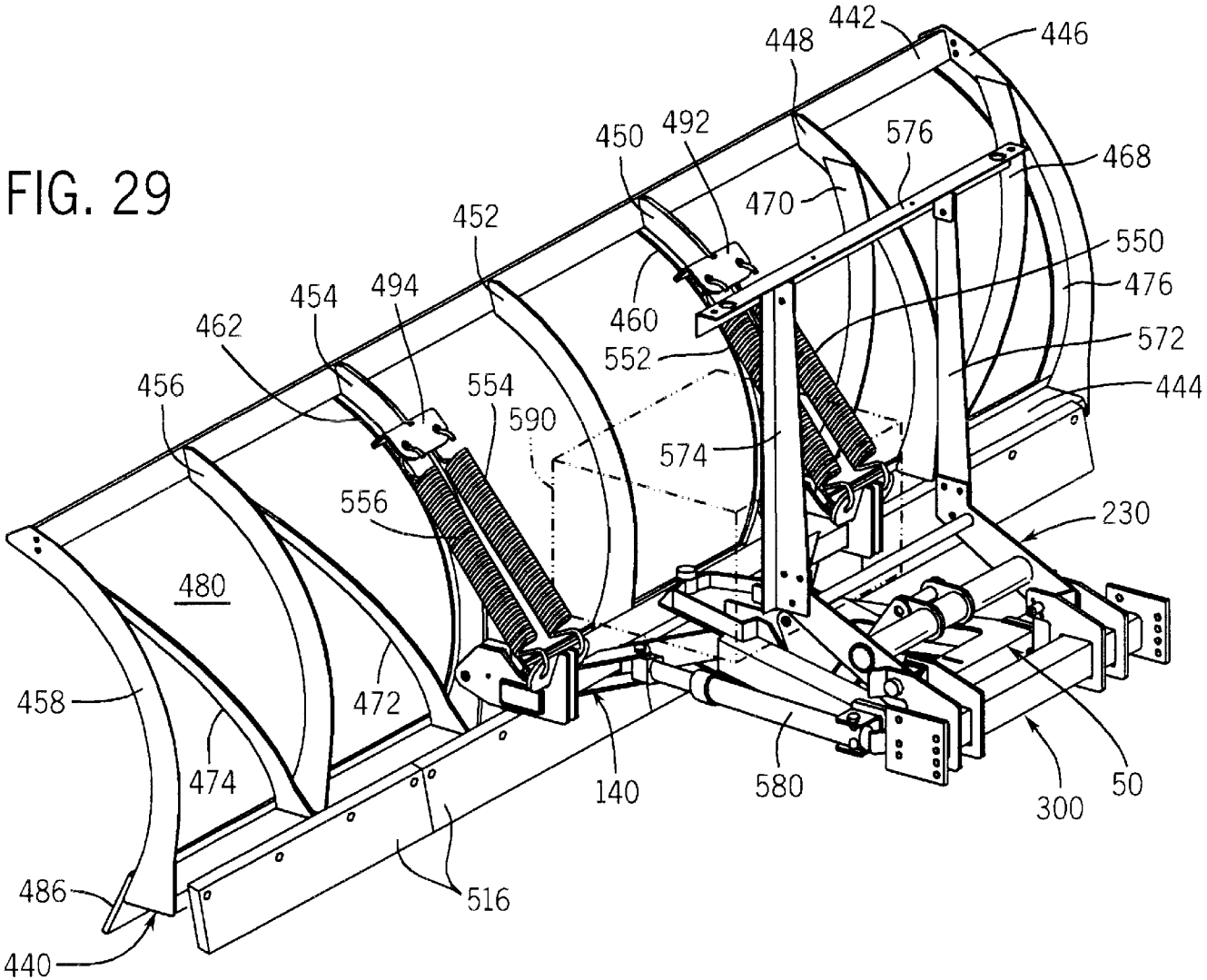
FIG. 29 is a perspective view of the assembled snow plow of the present invention.
Figure 30:
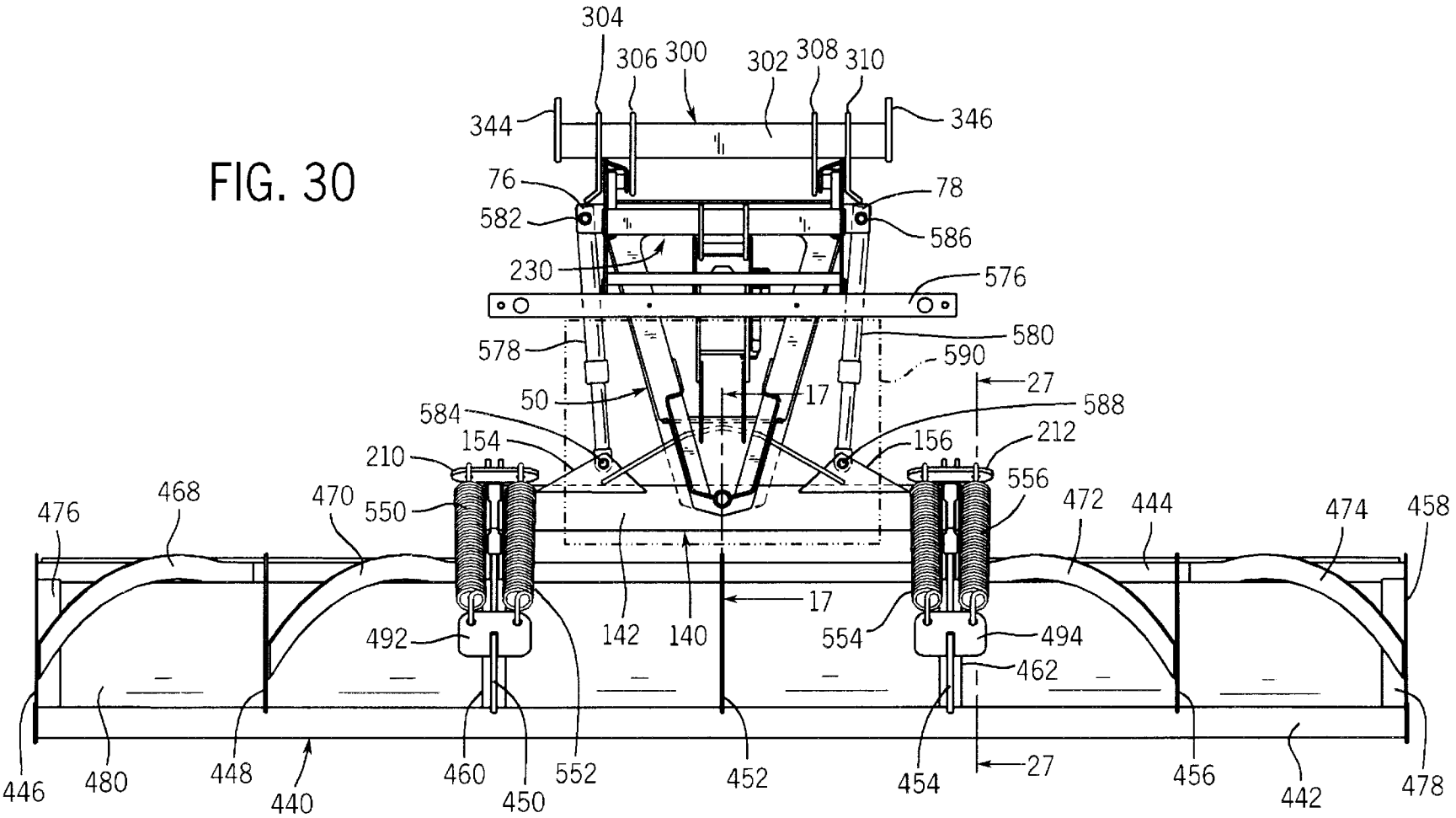
FIG. 30 is a top view of the assembled snow plow illustrated in FIG. 29.

Turning next to FIGS. 29 and 30, the assembly of several additional components is illustrated. First, all four of the trip springs 550, 552, 554, and 556 are illustrated as mounted onto the swing frame 140 and the plow blade 440. In addition, right and left light support towers 572 and 574, respectively, are mounted on the light bar supports 244 and 246, respectively, of the lift bar 230, and a light support bar 576 is mounted on the top ends of the right and left light support towers 572 and 574. Lights (not shown herein) would be mounted on the light support bar 576, in a manner well known to one skilled in the art.

In addition, right and left swing cylinders 578 and 580, respectively, are mounted between the plow A-frame 50 and the swing frame 140. The right swing cylinder 578 extends between the swing cylinder mount 76 on the plow A-frame 50 (where it is secured with a pin 582) and the swing cylinder mounting plates 154 and 158 on the swing frame 140 (where it is secured with a pin 584), and the left swing cylinder 580 extends between the swing cylinder mount 78 on the plow A-frame 50 (where it is secured with a pin 586) and the swing cylinder mounting plates 156 and 160 on the swing frame 140 (where it is secured with a pin 588). It will be understood that the pins 582, 584, 586, and 588 are all retained in place with cotter pins (not shown) as is well known to those skilled in the art.

Also not shown or discussed herein is the hydraulic system to operate the snow plow, the construction and operation of which is also well known to those skilled in the art. The right and left swing cylinders 578 and 580 are used to pivot the swing frame 140 and the plow blade 440 on the plow A-frame 50. The hydraulic cylinder 416 (shown in FIG. 10) is used to operate the stand 432 (also shown in FIG. 10) prior to the snow plow being mounted onto a truck, to facilitate the mounting of the snow plow onto the truck (as will become apparent below in conjunction with the discussion of FIGS. 31 through 37), and to raise and lower the plow A-frame 50, the swing frame 140, and the plow blade 440 after the snow plow has been mounted onto the truck. The hydraulic system for the snow plow may be mounted on the plow A-frame 50 at the front thereof, and if so mounted would have a hydraulic system cover 590 mounted thereupon to protect it, as shown in phantom lines.

Figure 33:
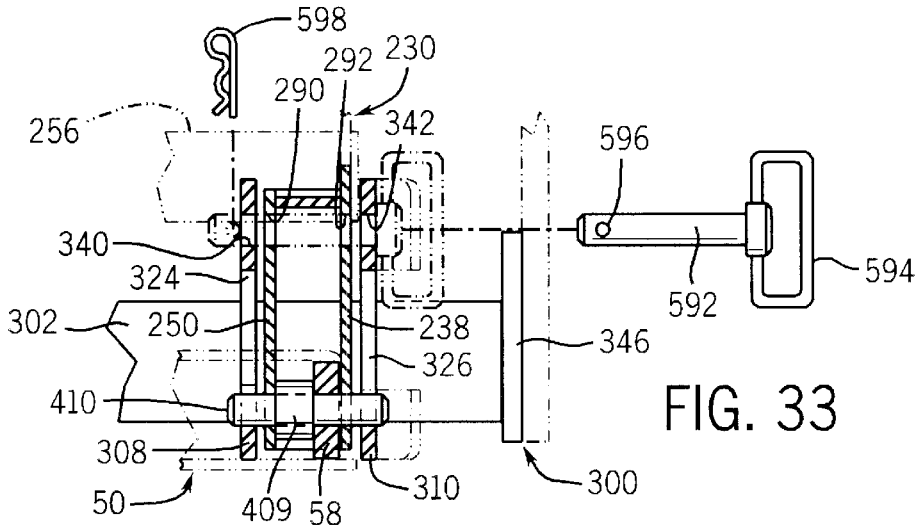
FIG. 33 is a partial cross-sectional view from the front showing the components illustrated in FIGS. 28 and 29 in a mounted position with the retaining pin inserted.
Figure 32:
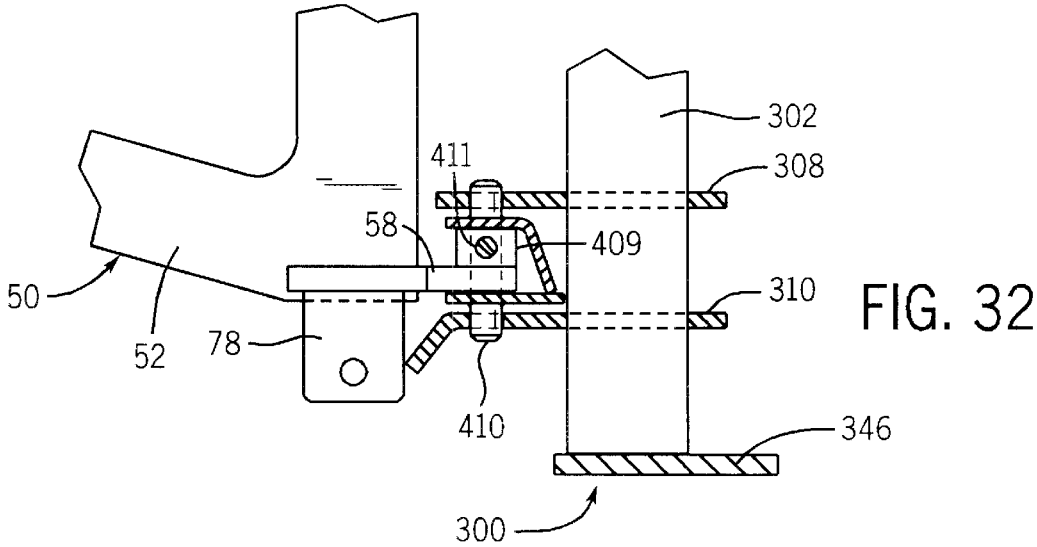
FIG. 32 is a partial view from the top showing the components illustrated in FIG. 31 in a mounted position.
Figure 31:
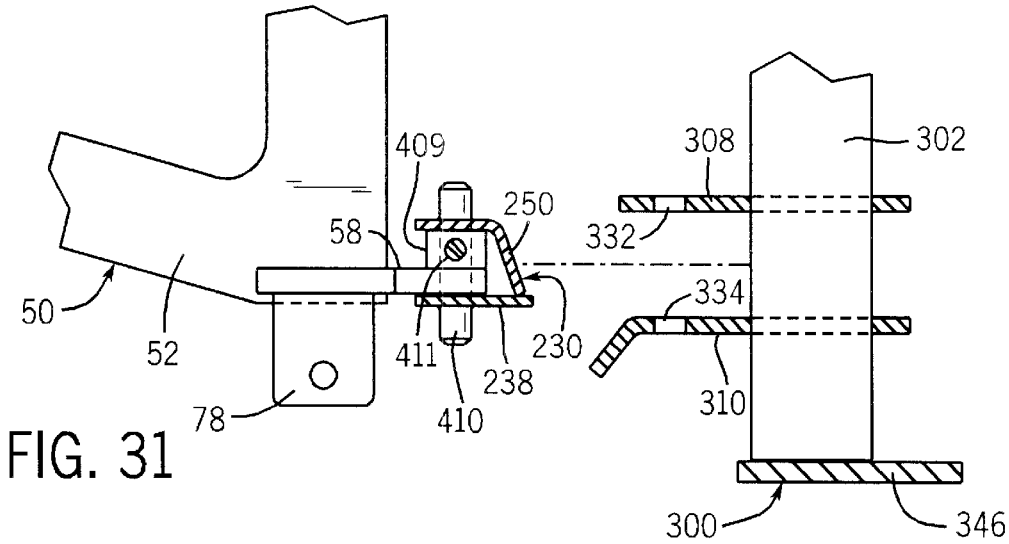
FIG. 31 is a partial view from the top showing the hitch mounting mechanism on one side of the snow plow illustrated in FIGS. 29 and 30 prior to installation.
Figure 35:
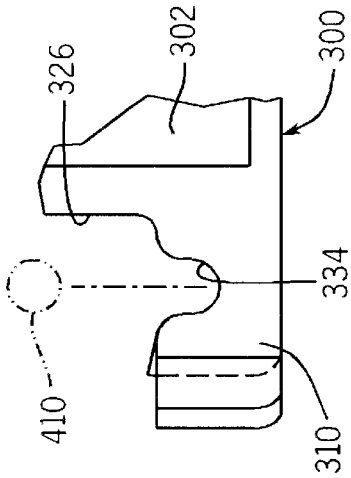
FIG. 35 is a schematic depiction of the engagement of the mounting pin with a slot in the hitch frame nose piece.

Referring now to FIGS. 31 through 37, the operation of the mounting system used to mount the snow plow on the hitch frame nose piece 300 is shown. Referring first to FIGS. 31 through 33, in conjunction with FIGS. 1, 6, 7, and 10, the mechanism used to connect the snow plow to the hitch frame nose piece 300 is shown. In the discussion herein, all references are to the left side of the snow plow and the hitch frame nose piece 300, but those skilled in the art will understand that the principles thereof are equally applicable to the right side of the snow plow and the hitch frame nose piece 300.

The snow plow is mounted onto the hitch frame nose piece 300 with the plow standing on the stand 432 (shown in FIG. 10). In this position, the pin 410 which extends laterally at the rear of the snow plow on the left side will be at a height such than when the truck having the hitch frame nose piece 300 mounted thereon moves forward, the pin 410 will fit into the rectangular notches 324 and 326 at the front of the hitch brackets 308 and 310, respectively. The pin 410 is brought fully into the rectangular notches 324 and 326 by moving the truck forward. It will be noted that the flange at the front of the hitch bracket 310 as well as the approximately seventy degree bend in the angled stock segment 250 will assist in guiding the rear mounting support 238 and the angled stock segment 250 of the lift bar 230 into position intermediate the hitch bracket 308 and 310.

A this point, the hydraulic cylinder 416 (shown in FIG. 10) is actuated to begin to retract it to raise the stand 432 (also shown in FIG. 10), causing the pin 410 to drop into the slots 332 and 334 in the hitch brackets 308 and 310, respectively. By continuing to actuate the hydraulic cylinder 416 to retract it, the lift bar 230 is pivoted to bring the apertures 290 and 292 in the angled stock segment 250 and the rear mounting support 238, respectively, of the lift bar 230 into alignment with the apertures 340 and 342 in the hitch brackets 308 and 310, respectively, of the hitch frame nose piece 300. At this point, a retaining pin 592 having a handle 594 may be inserted sequentially through the aperture 342 in the hitch bracket 310, the aperture 292 in the rear mounting support 238, the aperture 290 in the angled stock segment 250, and the aperture 340 in the hitch bracket 308. The retaining pin 592 has an aperture 596 extending through near the distal end thereof, and a retaining spring pin 598 is used to retain the retaining pin 592 in place.

Figure 34:
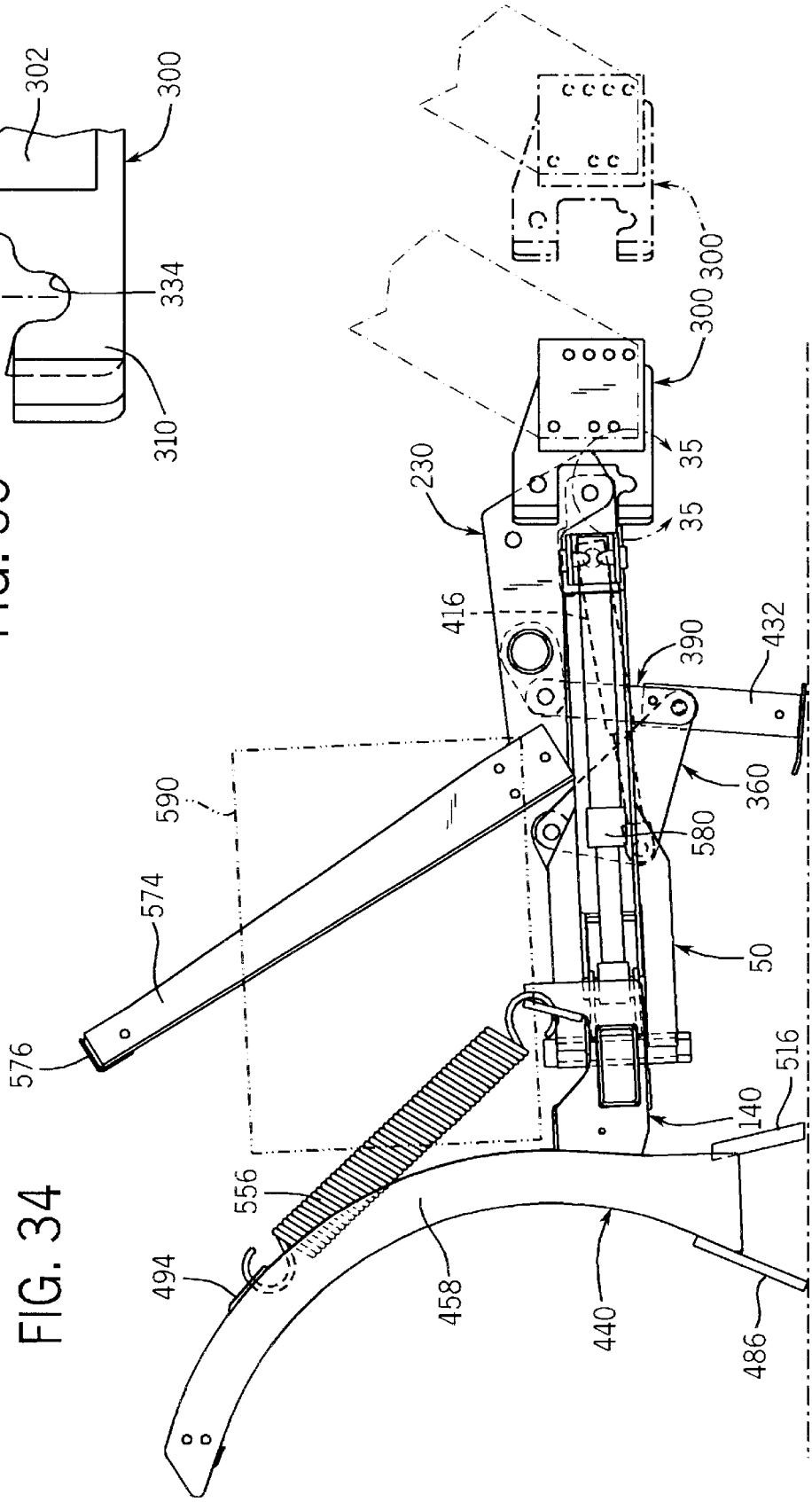
FIG. 34 is a side view of the snow plow illustrated in FIGS. 29 and 30 as the hitch frame nose piece is brought into engagement with a mounting pin on the pivoting lift bar.

Referring next to FIGS. 34 through 37, the installation of the snow plow onto the hitch frame nose piece 300 mounted on a truck 600 (shown in phantom lines in FIG. 37) is illustrated. In FIG. 34, the snow plow is shown in its stored position, supported on the stand 432. In this position, the hydraulic cylinder 416 is in its fully extended position, and the rear end of the snow plow is raised. In this position, the pin 408 (not shown in FIGS. 34 through 37) at the right rear of the snow plow will be received by the rectangular notches 320 and 322 (not shown in FIGS. 34 through 37) at the front of the hitch brackets 304 and 306 (not shown in FIGS. 34 through 37), respectively, at the right side of the hitch frame nose piece 300. Similarly, the pin 410 at the left rear of the snow plow will be received by the rectangular notches 324 (not shown in FIGS. 34 through 37) and 326 at the front of the hitch brackets 308 (not shown in FIGS. 34 through 37) and 310, respectively, at the left side of the hitch frame nose piece 300. The truck 600 may be driven forward to fully engage the pins 408 and 410 with the hitch frame nose piece 300 as shown in FIG. 34.

Figure 36:
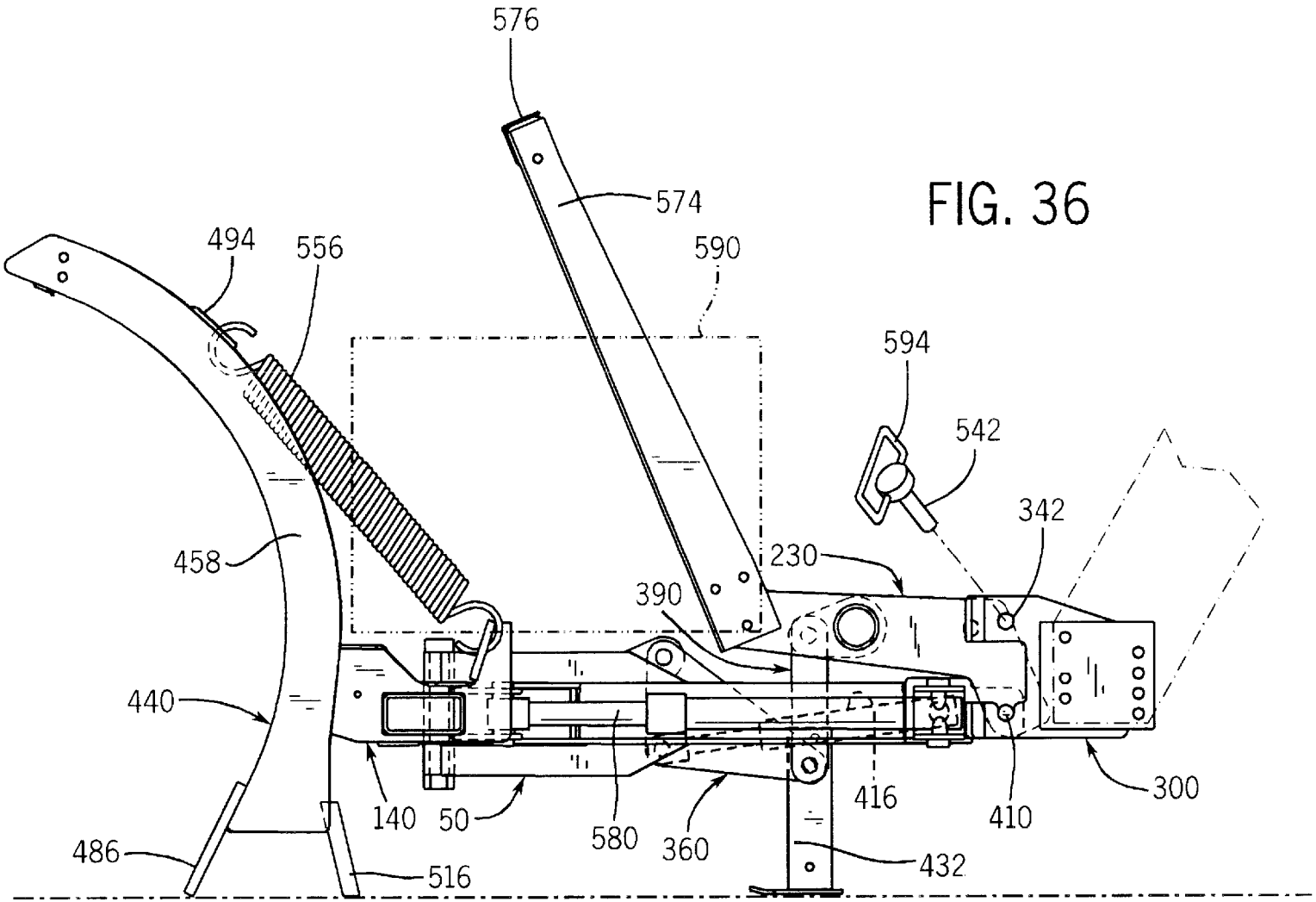
FIG. 36 is a side view similar to that of FIG. 34, with the pivoting lift bar beginning to pivot to bring the mounting pin into engagement with the slot in the hitch frame nose piece.

Next, as shown in FIG. 36, as the hydraulic cylinder 416 begins to retract, the plow A-frame 50 will lower at the rear end thereof as the stand 432 begins to move upwardly relative to the plow A-frame 50. This causes the pin 408 (not shown in FIGS. 34 through 37) to drop into the slots 328 and 330 (not shown in FIG. 36) in the hitch brackets 304 and 306 (not shown in FIG. 36), respectively, at the right side of the hitch frame nose piece 300. Similarly, the pin 410 drops into the slots 332 (not shown in FIG. 36) and 334 in the hitch brackets 308 (not shown in FIG. 36) and 310, respectively, at the left side of the hitch frame nose piece 300. This initial retraction of the hydraulic cylinder 416 also causes the lift bar 230 to begin to rotate clockwise as viewed from the left side of the snow plow, as is evident from the movement of the right light support towers 572 and 576 and the light support bar 576.

Figure 37:
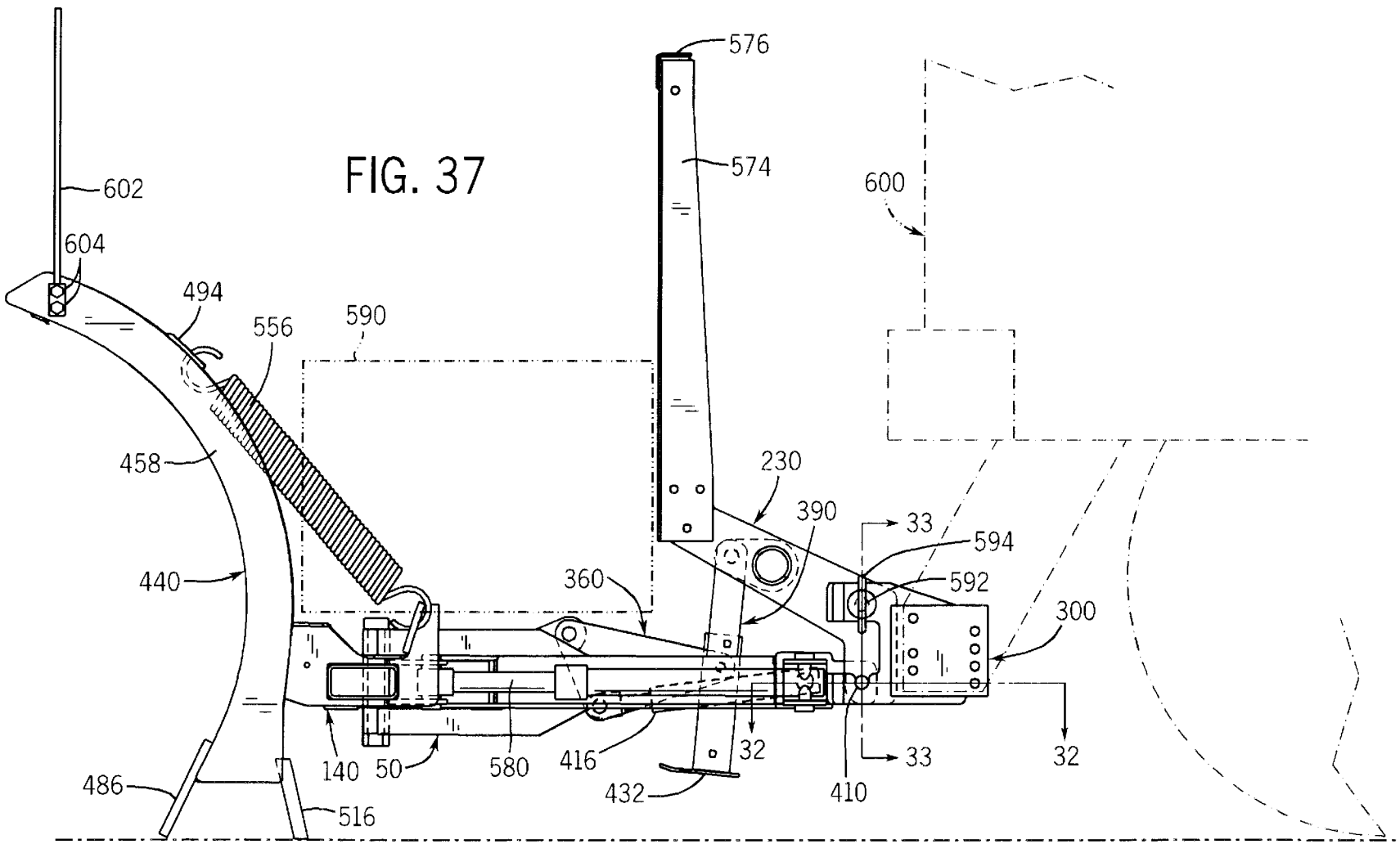
FIG. 37 is a side view similar to that of FIGS. 34 and 36, with the pivoting lift bar pivoted to bring the mounting holes in the pivoting lift bar into alignment with the mounting holes in the hitch frame nose piece.
Figure 38:
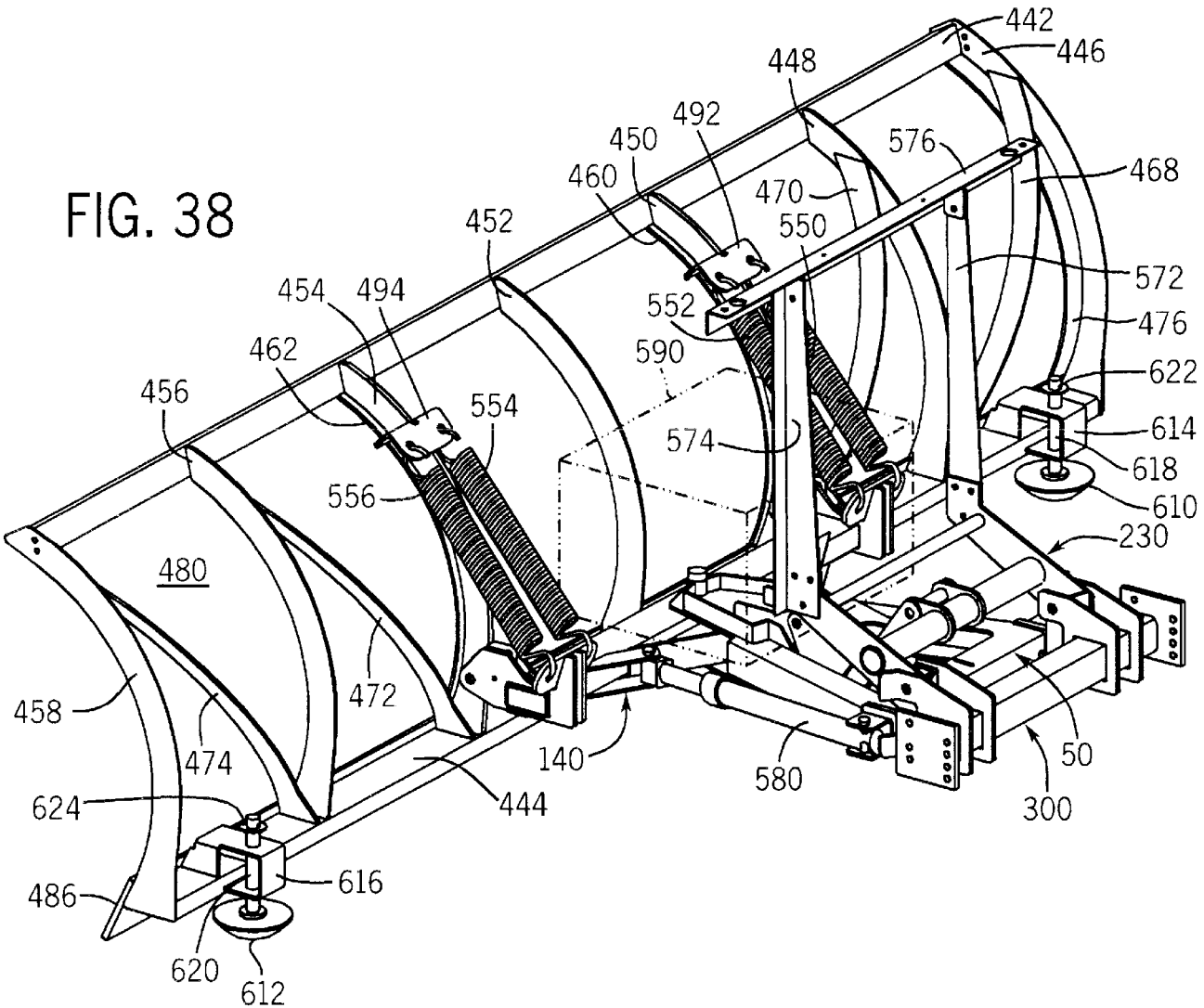
FIG. 38 is a perspective view of an alternate embodiment snow plow having blade shoes mounted thereupon.

As shown in FIG. 37, as the hydraulic cylinder 416 continues to retract, the lift bar 230 rotates clockwise until the light support towers 572 and 576 are oriented nearly vertically. As this further rotation occurs, the pin 408 (not shown in FIG. 37) remains in the slots 328 and 330 in the hitch brackets 304 and 306, respectively (none of which are shown in FIG. 37). Similarly, the pin 410 remains in the slots 332 (not shown in FIG. 37) and 334 in the hitch brackets 308 (not shown in FIG. 37) and 310, respectively. On the right side of the lift bar 230 and the hitch frame nose piece 300 (best shown in FIGS. 6 and 7), the apertures 286 and 288 in the rear mounting support 236 and the angled stock segment 248, respectively, of the lift bar 230 move into engagement with the apertures 336 and 338 in the hitch brackets 304 and 306, respectively, of the hitch frame nose piece 300. Likewise, on the left side of the lift bar 230 and the hitch frame nose piece 300 (portions of which are also best shown in FIGS. 6 and 7, respectively), the apertures 290 and 292 in the angled stock segment 250 and the rear mounting support 238, respectively, of the lift bar 230 move into alignment with the apertures 340 and 342 in the hitch brackets 308 and 310, respectively, of the hitch frame nose piece 300.

At this point, one of the retaining pins 592 is inserted sequentially through the aperture 336 in the hitch bracket 304, the aperture 286 in the rear mounting support 236, the aperture 288 in the angled stock segment 248, and the aperture 338 in the hitch bracket 306 (all of which are best shown in FIGS. 6 and 7). The other one of the retaining pins 592 is inserted sequentially through the aperture 342 in the hitch bracket 310, the aperture 292 in the rear mounting support 238, the aperture 290 in the angled stock segment 250, and the aperture 340 in the hitch bracket 308 (many of which are also best shown in FIGS. 6 and 7). The retaining spring pins 598 are then inserted into the apertures 596 near the distal ends of the retaining pins 592 to retain the retaining pins 592 in place. At this point, the stand 432 may also be moved to a stowed position by disconnecting it from the lift link 390 (by removal of the pin (not shown)) and rotating it to the stowed position as is taught in U.S. Pat. No. 5,894,688, which was incorporated by reference above.

Also shown in FIG. 37 is a marker bar 602, one of which may be mounted on each side of the plow blade 440 at the top thereof using the apertures 512 and 514 (not shown in FIG. 37) on the right and left sides of the plow blade 440, respectively, using bolts 604 and nuts (not shown herein). The marker bars 602 are used to allow the driver of the truck 600 to see where the front of the plow blade 440 is at any given time (since the driver may not be able to see the plow blade 440 over the hood of the truck 600 from the cab of the truck 600).

Referring finally to FIG. 38, a snow plow having an alternate embodiment is illustrated in which shoes 610 and 612 are installed on the plow blade 440. The shoes 610 and 612 are designed to ride in sliding contact with the surface to be plowed, and are particular useful on gravel or during the spring when the ground may not be fully frozen. The shoes 610 and 612 are mounted to the plow blade 440 using shoe mounts 614 and 616, respectively. The shoe mount 614 is mounted on the bottom plow frame member 444 near the right side thereof, and the shoe mount 616 is mounted on the bottom plow frame member 444 near the left side thereof. The shoe mounts 614 and 616 are preferably made of steel and are welded onto the bottom plow frame member 444.

The shoes 610 and 612 are mounted on posts 618 and 620, respectively, which posts 618 and 620 are received by the shoe mounts 614 and 616, respectively. The shoes 610 and 612 are adjusted using a combination of washers and tubular spacers, which are placed on the posts 618 and 620 either below or above the shoe mounts 614 and 616 to adjust the height of the shoes 610 and 612. The position of the shoes 610 and 612 relative to the plow blade 440 may be adjusted to adjust the height of the plow blade .440 relative to the surface to be plowed. This allows the degree to which the wearstrip 486 scrapes the surface to be plowed to be controlled. Retaining pins 622 and 624 are used on the posts 618 and 620, respectively, to retain them in the shoe mounts 614 and 616.

The shoes 610 and 612 are typically made out of cast iron. It should be noted that although the back blade wearstrip 516 is not shown in the embodiment illustrated in FIG. 38, it can in fact be used with the shoes 610 and 612, so long as the shoe mounts 614 and 616 extend sufficiently back to clear the back blade wearstrip 516. The shoes 610 and 612 have feet which are adapted to ride in sliding contact with the surface to be plowed. The position of the feet relative to the plow blade may be adjusted to adjust the height of the plow blade relative to the surface to be plowed. In this way, the degree to which the blade edge scrapes the surface to be plowed may be controlled.

It may therefore be appreciated from the above detailed description of the preferred embodiment of the present invention that it teaches an apparatus and method for mounting the trip springs on a snow plow in a manner whereby all of the force exerted by the trip springs is exerted in a direction which is orthogonal to the axis about which the snow plow blade pivots. The mounting brackets of the present invention facilitate the mounting of the trip springs in a manner which eliminates the exertion of any lateral force by the trip springs. The size of the trip springs required by the present invention is minimized by ensuring that all of the force which they exert is directed properly to provide the required force in the requisite direction.

The force exerted by the trip springs of the snow plow trip spring mount of the present invention is exerted proximate a plane which is orthogonal to the pivot points at which the snow plow blade is mounted to the snow plow blade support structure. In addition, the force of the trip springs is exerted on appropriate areas of the snow plow blade so that any potential distortion of the snow plow blade is inhibited. The snow plow trip spring mount of the present invention facilitates the use of either a single trip spring on either side of the snow plow blade or two trip springs on each side of the snow plow blade.

The snow plow trip spring mount of the present invention is of a construction which is both durable and long lasting, and which will require little or no maintenance to be provided by the user throughout its operating lifetime. The snow plow trip spring mount of the present invention is also of inexpensive construction to enhance its market appeal and to thereby afford it the broadest possible market. Finally, all of the aforesaid advantages and objectives of the snow plow trip spring mount of the present invention are achieved without incurring any substantial relative disadvantage.

Although an exemplary embodiment of the snow plow trip spring mount of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. In a snow plow having a snow plow frame for installation at the front of a vehicle, a blade mounting structure which is mounted on the snow plow frame and which supports a snow plow blade therefrom, said blade mounting structure comprising:

a blade support frame member having right and left ends, said blade support frame member being supported by the snow plow frame which may be mounted at the front of the vehicle;

said blade support frame member including right and left blade mounting members which are fixedly mounted adjacent said right and left ends of said blade support frame member, respectively, said right and left blade mounting members each defining a pivot point;

a snow plow blade having a frame comprising vertically oriented right and left mounting ribs, each of said right and left mounting ribs defining a pivot point;

connecting members used to pivotally connect said right mounting rib to said right blade mounting member and said left mounting rib to said left blade mounting member, said snow plow blade thereby being pivotable about a blade trip axis between a blade return position and a blade tripped position;

right and left trip spring brackets mounted on said blade support frame member;

right and left trip spring brackets mounted on said frame of said snow plow blade, wherein said right trip spring brackets each have right and left apertures located therein, and wherein said left trip spring brackets each have right and left apertures located therein, and wherein said right apertures in said right trip spring brackets are in a common plane substantially perpendicular to said blade trip axis, and wherein said left apertures in said right trip spring brackets are in a common plane substantially perpendicular to said blade trip axis, and wherein said right apertures in said left trip spring brackets are in a common plane substantially perpendicular to said blade trip axis, and wherein said left apertures in said left trip spring brackets are in a common plane substantially perpendicular to said blade trip axis; and trip springs extending between said right and left trip spring brackets on said blade support frame member and said right and left trip spring brackets on said frame of said snow plow frame, respectively, said trip springs exerting forces which bias said snow plow blade from said blade tripped position to said blade return position, said forces being exerted in directions which are substantially orthogonal to said blade trip axis.

2. A blade mounting structure as defined in claim 1, wherein there is a single trip spring extending between said right trip spring bracket on said blade support frame member and said right trip spring bracket on said frame of said snow plow blade, and wherein there is a single trip spring extending between said left trip spring bracket on said blade support frame member and said left trip spring bracket on said frame of said snow plow blade.

3. A blade mounting structure as defined in claim 1, wherein there are two trip springs each of which extends between said right trip spring bracket on said blade support frame member and said right trip spring bracket on said frame of said snow plow blade, and wherein there are two trip springs each of which extends between said left trip spring bracket on said blade support frame member and said left trip spring bracket on said frame of said snow plow blade.

4. A blade mounting structure as defined in claim 1, wherein said right and left trip spring brackets mounted on said blade support frame member are mounted on said right and left blade mounting members, respectively.

5. A blade mounting structure as defined in claim 4, wherein said right blade mounting member comprises:

a first pair of blade pivot mounts which is mounted on said blade support frame member near said right end thereof, said first pair of blade pivot mounts being spaced away from each other and extending forwardly from said blade support frame member, said first pair of blade pivot mounts each having an aperture extending therethrough in the portion thereof which extends forwardly from said blade support frame member, said first pair of blade pivot mounts also extending rearwardly, said right trip spring bracket on said blade support frame being mounted on the rearwardly extending portions of said first pair of blade pivot mounts;

and wherein said left blade mounting member comprises:

a second pair of blade pivot mounts which is mounted on said blade support frame member near said left end thereof, said second pair of blade pivot mounts being spaced away from each other and extending forwardly from said blade support frame member, said second pair of blade pivot mounts each having an aperture extending therethrough in the portion thereof which extends forwardly from said blade support frame member, said second pair of blade pivot mounts also extending rearwardly, said left trip spring brackets on said blade support frame being mounted on the rearwardly extending portions of said second pair of blade pivot mounts.

6. A blade mounting structure as defined in claim 5, wherein said pivot point in each of said right and left mounting ribs is defined by an aperture extending through each of said right and left mounting ribs, and wherein said right and left trip spring brackets on said snow plow frame are mounted on said right and left mounting ribs, respectively, at locations which are spaced away from said apertures in said right and left mounting ribs.

7. A blade mounting structure as defined in claim 6, wherein said one of said connecting members extends sequentially through said aperture in one of said first pair of blade pivot mounts, said aperture in said right mounting rib, and said aperture in the other of said first pair of blade pivot mounts, and wherein said other of said connecting members extends sequentially through said aperture in one of said second pair of blade pivot mounts, said aperture in said left mounting rib, and said aperture in the other of said second pair of blade pivot mounts.

8. A blade mounting structure as defined in claim 7, wherein said connecting members each comprise:

a pin; and a retaining element which may be secured to said pin to retain said pin in place.

9. A blade mounting structure as defined in claim 6, wherein said right and left trip spring brackets mounted on said frame of said snow plow blade are mounted on said right and left mounting ribs, respectively.

10. A blade mounting structure as defined in claim 5, wherein said right and left trip spring brackets mounted on said blade support frame member are mounted on said first and second pair of blade pivot mounts, respectively.

11. A blade mounting structure as defined in claim 1, wherein said right trip spring bracket mounted on said frame of said snow plow blade is mounted on said right mounting rib, and wherein said left trip spring bracket mounted on said frame of said snow plow blade is mounted on said left mounting rib, and wherein said right trip spring bracket mounted on said blade support frame member is mounted on said right blade mounting member, and wherein said left trip spring bracket mounted on said blade support frame member is mounted on said left blade mounting member.

12. A blade mounting structure as defined in claim 1, wherein said right trip spring brackets each have a single aperture located therein, and wherein said left trip spring brackets each have a single aperture located therein, and wherein said apertures in said right trip spring brackets are in a common plane perpendicular to said blade trip axis, and wherein said apertures in said left trip spring brackets are in a common plane perpendicular to said blade trip axis.

13. In a snow plow having a snow plow frame for installation at the front of a vehicle, a blade mounting structure which is mounted on the snow plow frame and which supports a snow plow blade therefrom, said blade mounting structure comprising:

a blade support frame member having right and left ends, said blade support frame member being supported by the snow plow frame which may be mounted at the front of the vehicle;

said blade support frame member including right and left blade mounting members which are fixedly mounted adjacent said right and left ends of said blade support frame member, respectively, said right and left blade mounting members each defining a pivot point;

a snow plow blade having a frame comprising vertically oriented right and left mounting ribs, each of said right and left mounting ribs defining a pivot point;

connecting members used to pivotally connect said right mounting rib to said right blade mounting member and said left mounting rib to said left blade mounting member, said snow plow blade thereby being pivotable about a blade trip axis between a blade return position and a blade tripped position;

right and left trip spring brackets mounted on said blade support frame member, wherein said right trip spring brackets each have right and left apertures located therein, and wherein said left trip spring brackets each have right and left apertures located therein, and wherein said right apertures in said right trip spring brackets are in a common plane perpendicular to said blade trip axis, and wherein said left apertures in said right trip spring brackets are in a common plane perpendicular to said blade trip axis, and wherein said right apertures in said left trip spring brackets are in a common plane perpendicular to said blade trip axis, and wherein said left apertures in said left trip spring brackets are in a common plane perpendicular to said blade trip axis;

right and left trip spring brackets mounted on said frame of said snow plow blade; and trip springs extending between said right and left trip spring brackets on said blade support frame member and said right and left trip spring brackets on said frame of said snow plow frame, respectively, said trip springs exerting forces which bias said snow plow blade from said blade tripped position to said blade return position, said forces being exerted in directions which are substantially orthogonal to said blade trip axis.

14. A blade mounting structure as defined in claim 13, wherein said right and left apertures in said right trip spring brackets are on opposite sides of said right mounting rib, and wherein said right and left apertures in said left trip spring brackets are on opposite sides of said left mounting rib.

15. A blade mounting structure as defined in claim 14, wherein said right and left apertures in said right trip spring brackets are approximately equidistant from said right mounting rib, and wherein said right and left apertures in said left trip spring brackets are approximately equidistant from said left mounting rib.

16. A blade mounting structure as defined in claim 1, wherein said blade support frame member, said right and left blade mounting members, and said right and left trip spring brackets mounted on said blade support member are all made of steel and are welded together.

17. A blade mounting structure as defined in claim 1, wherein said frame of said snow plow blade and said right and left trip spring brackets mounted on said frame of said snow plow blade are all made of steel and are welded together.

18. In a snow plow having a snow plow frame for detachable installation at the front of a vehicle, a blade mounting structure which is mounted on the snow plow frame and which supports a snow plow blade therefrom, said blade mounting structure comprising:

a blade support frame member having right and left ends, said blade support frame member being supported by the snow plow frame which may be detachably installed at the front of the vehicle;

a first pair of blade pivot mounts which is mounted on said blade support frame member near said right end thereof, said first pair of blade pivot mounts being spaced away from each other and extending forwardly from said blade support frame member, said first pair of blade pivot mounts each having an aperture extending therethrough in the portion thereof which extends forwardly from said blade support frame member;

a second pair of blade pivot mounts which is mounted on said blade support frame member near said left end thereof, said second pair of blade pivot mounts being spaced away from each other and extending forwardly from said blade support frame member, said second pair of blade pivot mounts each having an aperture extending therethrough in the portion thereof which extends forwardly from said blade support frame member;

a snow plow blade having a frame comprising a top plow frame member, a bottom plow frame member, and a plurality of curved ribs extending between said top and bottom plow frame members including right and left mounting ribs which each have an aperture extending therethrough, which apertures in said right and left mounting ribs each define pivot points for said snow plow blade;

a first connecting member used to pivotally connect said right mounting rib intermediate said first pair of blade pivot mounts, and a second connecting member used to pivotally connect said left mounting rib intermediate said second pair of blade pivot mounts, said snow plow blade thereby being pivotable about a blade trip axis defined by said first and second pivot mounts between a blade return position and a blade tripped position;

a right trip spring bracket mounted on said first pair of blade pivot mounts;

a left trip spring bracket mounted on said second pair of blade pivot mounts;

a right trip spring bracket mounted on said right mounting rib nearer said top plow frame member than said bottom plow frame member;

a left trip spring bracket mounted on said left mounting rib nearer said top plow frame member than said bottom plow frame member;

said right trip spring brackets each have right and left apertures located therein, and wherein said left trip spring brackets each have right and left apertures located therein, and wherein said right apertures in said right trip spring brackets are in a common plane substantially perpendicular to said blade trip axis, and wherein said left apertures in said right trip spring brackets are in a common plane substantially perpendicular to said blade trip axis, and wherein said right apertures in said left trip spring brackets are in a common plane substantially perpendicular to said blade trip axis, and wherein said left apertures in said left trip spring brackets are in a common plane substantially perpendicular to said blade trip axis;

at least one trip spring mounted between said right trip spring brackets; and at least one trip spring mounted between said left trip spring brackets, said trip springs biasing said snow plow blade from said blade tripped position to said blade return position.

19. A blade mounting structure for supporting a snow plow blade, said blade mounting structure being mounted on a snow plow frame which may be installed at the front of a vehicle, said blade mounting structure comprising:

a blade support frame member with right and left ends which is supported from the snow plow frame which may be installed at the front of the vehicle;

right and left blade mounting members which are fixedly mounted adjacent to said right and left ends of said blade support frame member, respectively;

right and left mounting ribs contained in a frame of a snow plow blade which are pivotally mounted to said right and left blade mounting members, respectively, said snow plow blade thereby being pivotable about a blade trip axis between a blade return position and a blade tripped position; and blade biasing members which exert forces to bias said snow plow blade from said blade tripped position to said blade return position, said forces being exerted in planes which are substantially orthogonal to said blade trip axis.

20. A method of supporting a snow plow blade on a blade mounting structure which is mounted on a snow plow frame which may be installed at the front of a vehicle, said method comprising:

supporting a blade support frame member having right and left ends from the snow plow frame which is installed at the front of the vehicle;

fixedly mounting right and left blade mounting members adjacent to said right and left ends of said blade support frame member, respectively;

pivotally mounting right and left mounting ribs contained in a frame of a snow plow blade to said right and left blade mounting members, respectively, said snow plow blade thereby being pivotable about a blade trip axis between a blade return position and a blade tripped position; and exerting forces to bias said snow plow blade from said blade tripped position to said blade return position, said forces being exerted in planes which are substantially orthogonal to said blade trip axis.

* * * * *